US012134539B2

(12) United States Patent
Hashiguchi et al.

(10) Patent No.: US 12,134,539 B2
(45) Date of Patent: Nov. 5, 2024

(54) POST-PROCESSING DEVICE, METHOD FOR CONTROLLING POST-PROCESSING DEVICE, AND NON-TRANSITORY COMPUTER-READABLE STORAGE MEDIUM STORING PROGRAM FOR CONTROLLING POST-PROCESSING DEVICE

(71) Applicant: SEIKO EPSON CORPORATION, Tokyo (JP)

(72) Inventors: Namiki Hashiguchi, Shiojiri (JP); Masahide Moriyama, Matsumoto (JP); Masayoshi Miyakawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 18/497,120

(22) Filed: Oct. 30, 2023

(65) Prior Publication Data

US 2024/0059520 A1 Feb. 22, 2024

Related U.S. Application Data

(63) Continuation of application No. 18/150,871, filed on Jan. 6, 2023, now Pat. No. 11,840,418, which is a (Continued)

(30) Foreign Application Priority Data

Jul. 17, 2020 (JP) ..... 2020-122773

(51) Int. Cl.
*B65H 37/04* (2006.01)
*B65H 7/20* (2006.01)

(52) U.S. Cl.
CPC ..... *B65H 37/04* (2013.01); *B65H 7/20* (2013.01); *B65H 2301/13* (2013.01); *B65H 2511/12* (2013.01); *B65H 2515/70* (2013.01)

(58) Field of Classification Search
CPC ..... B65H 37/04; B65H 7/20; B65H 2515/70; B41F 13/66; B41L 43/12; B42C 1/12;
(Continued)

(56) References Cited

U.S. PATENT DOCUMENTS 10,632,644 B2 4/2020 Lee
2002/0076232 A1 6/2002 Taneka
(Continued)

FOREIGN PATENT DOCUMENTS

EP 3923079 12/2021
JP 2011126625 6/2011
(Continued)

*Primary Examiner* — Leslie A Nicholson, III
(74) *Attorney, Agent, or Firm* — WORKMAN NYDEGGER

(57) ABSTRACT

A post-processing unit includes a stapler, a driving section, and a controller. The stapler is moved in a Y direction and executes a stapling process on a paper sheet. The driving section moves the stapler in the Y direction. The controller controls an operation of the stapler and an operation of the driving section. The controller executes first control to supply a set current or a set voltage to the driving section, second control to supply, to the driving section, the same supply current as the set current or the same supply voltage as the set voltage, and third control to stop the supply of the supply current or the supply voltage. When the stapler executes the stapling process a plurality of times, the controller repeatedly executes the second control and the third control and causes the stapler to execute the stapling process during the execution of the second control.

12 Claims, 14 Drawing Sheets

Related U.S. Application Data continuation of application No. 17/305,745, filed on Jul. 14, 2021, now Pat. No. 11,591,178.

(58) Field of Classification Search

CPC ..... G03G 2215/00864; G03G 2215/00827; B31F 5/001; H04N 1/00639

USPC ..... 270/58.08

See application file for complete search history.

(56) References Cited

U.S. PATENT DOCUMENTS

| | | | |
|---|---|---|---|
| 2009/0230605 | A1 | 9/2009 | Taguchi |
| 2011/0233842 | A1 | 9/2011 | Matsuo |
| 2012/0082497 | A1 | 4/2012 | Nagasaki |
| 2021/0364972 | A1 | 11/2021 | Noda |

FOREIGN PATENT DOCUMENTS

| | | |
|---|---|---|
| JP | 2011201679 | 10/2011 |
| JP | 2016167004 | 9/2016 |
| JP | 2021187576 | 12/2021 |

POST-PROCESSING DEVICE, METHOD FOR CONTROLLING POST-PROCESSING DEVICE, AND NON-TRANSITORY COMPUTER-READABLE STORAGE MEDIUM STORING PROGRAM FOR CONTROLLING POST-PROCESSING DEVICE

The present application is a continuation of U.S. patent application Ser. No. 18/150,871, filed Jan. 6, 2023, which is a continuation of U.S. patent application Ser. No. 17/305,745, filed Jul. 14, 2021, which is based on, and claims priority from JP Application Serial Number 2020-122773, filed Jul. 17, 2020, the disclosures of which are hereby incorporated by reference herein in their entirety.

BACKGROUND

1. Technical Field

The present disclosure relates to a post-processing device, a method for controlling the post-processing device, and a non-transitory computer-readable storage medium storing a program for controlling the post-processing device.

2. Related Art

A sheet post-processing device described in JP-A-2011-201679 includes a stapling processing section that has a stapler, a moving table on which the stapler is mounted, and a base member that holds the stapler via the moving table. A motor that serves as a driving source for the stapler is not electrically locked.

In the configuration described in JP-A-2011-201679, a unit that mechanically holds a post-processing section is required. Therefore, it is difficult to simplify the configuration of the post-processing device. In addition, in a configuration in which an operation of the driving source for the post-processing section in the related art is electrically kept, it is necessary to separately set a current value to be used to move the post-processing section and a current value to be used to keep the operation of the driving source, and, for example, a configuration for converting output, such as a DC-DC converter, is further required. Therefore, it is difficult to simplify the configuration.

Furthermore, the current value to be used to keep the operation of the driving source is lower than the current value to be used to move the post-processing section. Therefore, when post-processing is executed a plurality of times, a component of impact force caused by the operation of the post-processing section may act on the post-processing section and the position of the post-processing section may deviate.

SUMMARY

To solve the foregoing problems, according to an aspect of the present disclosure, a post-processing device includes a post-processing section that is configured to move over a mounting section on which a medium is mounted in a width direction intersecting a transport direction of the medium and that executes post-processing on the medium mounted on the mounting section, a driving section that moves the post-processing section in the width direction when supplied with a current or a voltage from a power supply, and a controller that controls an operation of the post-processing section and an operation of the driving section. The controller is configured to execute first control to move the post-processing section in the width direction by supplying a set current or a set voltage set in advance from the power supply to the driving section, second control to hold the position of the post-processing section in the width direction by supplying, to the driving section, a supply current with the same value as a value of the set current or a supply voltage with the same value as a value of the set voltage, and third control to stop the supply of the supply current or the supply voltage to the driving section. When the post-processing section executes the post-processing on the medium a plurality of times, the controller repeatedly executes the second control and the third control and causes the post-processing section to execute the post-processing during the execution of the second control.

To solve the foregoing problems, according to another aspect of the present disclosure, a method for controlling a post-processing device including a post-processing section that is configured to move over a mounting section on which a medium is mounted in a width direction intersecting a transport direction of the medium and that executes post-processing on the medium mounted on the mounting section, and a driving section that moves the post-processing section in the width direction when supplied with a current or a voltage from a power supply includes a moving step of moving the post-processing section in the width direction by supplying a set current or a set voltage set in advance from the power supply to the driving section, a holding step of holding the position of the post-processing section in the width direction by supplying, to the driving section, a supply current with the same value as a value of the set current or a supply voltage with the same value as a value of the set voltage, and a stopping step of stopping the supply of the supply current or the supply voltage to the driving section. When the post-processing section executes the post-processing on the medium a plurality of times, the holding step and the stopping step are repeatedly executed and the post-processing section executes the post-processing during the execution of the holding step.

To solve the foregoing problems, according to still another aspect of the present disclosure, a non-transitory computer-readable storage medium stores a program for controlling a post-processing device including a post-processing section that is configured to move over a mounting section on which a medium is mounted in a width direction intersecting a transport direction of the medium and that executes post-processing on the medium mounted on the mounting section, and a driving section that moves the post-processing section in the width direction when supplied with a current or a voltage from a power supply. The program causes a computer to execute a moving step of moving the post-processing section in the width direction by supplying a set current or a set voltage set in advance from the power supply to the driving section, a holding step of holding the position of the post-processing section in the width direction by supplying, to the driving section, a supply current with the same value as a value of the set current or a supply voltage with the same value as a value of the set voltage, a stopping step of stopping the supply of the supply current or the supply voltage to the driving section, and a processing step of repeatedly executing the holding step and the stopping step and causing the post-processing section to execute the post-processing during the execution of the holding step when the post-processing section executes the post-processing on the medium a plurality of times.

DESCRIPTION OF EXEMPLARY EMBODIMENTS

Figure 1:
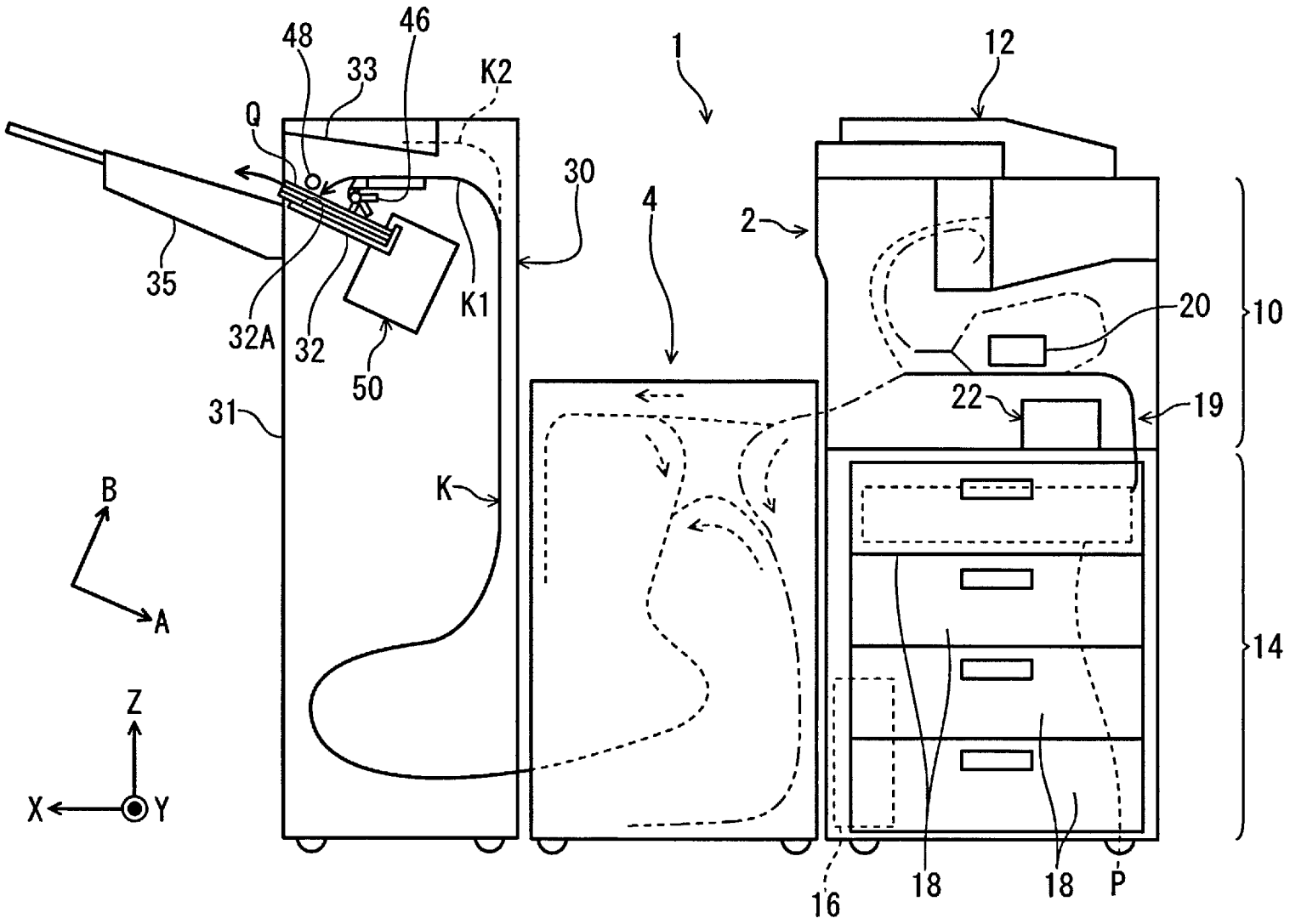
FIG. 1 is an overall view of a recording system according to a first embodiment.

The present disclosure is briefly described below.

To solve the foregoing problems, according to a first aspect of the present disclosure, a post-processing device includes a post-processing section that is configured to move over a mounting section on which a medium is mounted in a width direction intersecting a transport direction of the medium and that executes post-processing on the medium mounted on the mounting section, a driving section that moves the post-processing section in the width direction when supplied with a current or a voltage from a power supply, and a controller that controls an operation of the post-processing section and an operation of the driving section. The controller is configured to execute first control to move the post-processing section in the width direction by supplying a set current or a set voltage set in advance from the power supply to the driving section, second control to hold the position of the post-processing section in the width direction by supplying, to the driving section, a supply current with the same value as a value of the set current or a supply voltage with the same value as a value of the set voltage, and third control to stop the supply of the supply current or the supply voltage to the driving section. When the post-processing section executes the post-processing on the medium a plurality of times, the controller repeatedly executes the second control and the third control and causes the post-processing section to execute the post-processing during the execution of the second control.

According to the first aspect, in the first control and the second control, the set current and the supply current have the same value or the set voltage and the supply voltage have the same value. Therefore, a converter that changes the magnitude of the supply current to be output and supplied to the driving section or the magnitude of the supply voltage to be output and supplied to the driving section is not required. Therefore, the configuration of the post-processing device can be simplified.

Furthermore, according to the first aspect, the post-processing is executed by the post-processing section in a state in which force to hold the post-processing section is increased by supplying, to the driving section, the supply current or the supply voltage that has the same value as the set current or the set voltage. Therefore, even when a component of impact force caused by an operation of executing the post-processing acts on the post-processing section, it is possible to suppress a deviation of the position of the post-processing section in the width direction.

According to a second aspect of the present disclosure, in the first aspect, when the post-processing is executed a plurality of times at a single set position in the width direction on the medium, the controller repeatedly executes the second control and the third control without executing the first control.

According to the second aspect, since the first control is not executed in the post-processing executed the plurality of times, a speed at which the post-processing is executed can be higher than that in a configuration in which the first control is executed every time the post-processing is to be executed.

According to a third aspect of the present disclosure, in the first aspect, when the post-processing is executed a plurality of times at a first position and a second position different from the first position in the width direction on the medium, the controller executes the third control at the first position and the second position.

According to the third aspect, when the post-processing section is present at the first position or the second position, the supply of the supply current or the supply voltage to the driving section is stopped. Therefore, it is possible to reduce power to be consumed by the post-processing device, compared to a configuration in which the supply current or the supply voltage is continuously supplied to the driving section.

According to a fourth aspect of the present disclosure, in any one of the first to third aspects, the controller synchronizes an operation of the post-processing section to execute the post-processing with an operation of the driving section using, as a reference time point, a time point when a signal is input before the start of the operation of the post-processing section to execute the post-processing.

According to the fourth aspect, since the operation of the post-processing section to execute the post-processing is synchronized with the operation of the driving section, an extra supply current or an extra supply voltage is hardly supplied, compared to a configuration in which the operations are not synchronized. Therefore, it is possible to reduce power to be consumed by the post-processing device.

According to a fifth aspect of the present disclosure, in any one of the first to fourth aspects, the controller starts the supply of the supply current or the supply voltage to the driving section before the start time of an operation of executing the post-processing.

According to the fifth aspect, before the start time of the operation of the post-processing section to execute the post-processing, force to hold the post-processing section by the driving section is increased. Therefore, when the post-processing is executed by the post-processing section, it is possible to suppress a deviation of the position of the post-processing section in the width direction.

According to a sixth aspect of the present disclosure, in the fifth aspect, when a set time period elapses after the start time of the supply of the supply current or the supply voltage to the driving section, the controller stops the supply of the current or the voltage to the driving section.

According to the sixth aspect, when the set time period elapses after the start time of the supply of the supply current or the supply voltage to the driving section, the supply of the current or the voltage from the power supply to the driving section is stopped. Therefore, it is possible to further reduce power to be consumed by the post-processing device, compared to a configuration in which the current or the voltage is supplied to the driving section for a time period longer than the set time period.

According to a seventh aspect of the present disclosure, in the fifth or sixth aspect, when a set elapsed time period elapses after the end time of the operation of the post-processing section to execute the post-processing, the controller stops the supply of the current or the voltage from the power supply to the driving section.

According to the seventh aspect, when the set elapsed time period elapses after the end time of the operation of the post-processing section to execute the post-processing, the supply of the current or the voltage from the power supply to the driving section is stopped. Therefore, it is possible to further reduce power to be consumed by the post-processing device, compared to a configuration in which the current or the voltage is supplied to the driving section for a time period longer than the set elapsed time period.

According to an eighth aspect of the present disclosure, in any one of the first to seventh aspects, a first time period from the end time of the post-processing to the end time of the second control is longer than a second time period from the start time of the second control to the start time of the post-processing.

According to the eighth aspect, since the holding of the position of the post-processing section is released after the termination of the operation of the post-processing section, it is possible to suppress a deviation of the position of the post-processing section in the width direction while reducing power to be consumed by the post-processing device.

According to a ninth aspect of the present disclosure, in any one of the first to eighth aspects, the controller causes the post-processing section to execute the post-processing without executing the second control in the last post-processing among the plurality of times of the post-processing.

Since the post-processing is not executed after the execution of the last post-processing, a problem does not occur even when the position of the post-processing section deviates in the width direction.

According to the ninth aspect, since the number of times that the second control is executed is reduced by 1, it is possible to reduce power to be consumed by the post-processing device, compared to a configuration in which the second control is executed every time the post-processing that is executed a plurality of times is to be executed.

According to a tenth aspect of the present disclosure, in any one of the first to ninth aspects, when the number of times that the post-processing is executed on a single portion of the medium is 1, the controller causes the post-processing section to execute the post-processing without executing the second control.

When the number of times that the post-processing is executed on a single portion of the medium is 1, the post-processing is not executed after the execution of the post-processing. Therefore, a problem does not occur even when the position of the post-processing section deviates in the width direction.

According to the tenth aspect, since the second control is not executed, it is possible to reduce power to be consumed by the post-processing device, compared to a configuration in which the second control is executed when the post-processing is to be executed once.

According to an eleventh aspect of the present disclosure, in any one of the first to tenth aspects, the post-processing section is a stapling section that staples the medium, the driving section includes a stepping motor having a coil that is excited by supplying a current to the coil, and force that acts on the stapling section in the width direction when the stapling section staples the medium is larger than holding force caused by detent torque when the coil is not excited.

According to the eleventh aspect, since the force that acts on the stapling section in the width direction increases, it is possible to easily move the stapling section in the width direction as a result.

According to a twelfth aspect of the present disclosure, a method for controlling a post-processing device including a post-processing section that is configured to move over a mounting section on which a medium is mounted in a width direction intersecting a transport direction of the medium and that executes post-processing on the medium mounted on the mounting section, and a driving section that moves the post-processing section in the width direction when supplied with a current or a voltage from a power supply includes a moving step of moving the post-processing section in the width direction by supplying a set current or a set voltage set in advance from the power supply to the driving section, a holding step of holding the position of the post-processing section in the width direction by supplying, to the driving section, a supply current with the same value as a value of the set current or a supply voltage with the same value as a value of the set voltage, and a stopping step of stopping the supply of the supply current or the supply voltage to the driving section. When the post-processing section executes the post-processing on the medium a plurality of times, the holding step and the stopping step are repeatedly executed and the post-processing section executes the post-processing during the execution of the holding step.

According to the twelfth aspect, it is possible to obtain the same actions and effects as those obtained by the post-processing device according to the first aspect.

According to a thirteenth aspect of the present disclosure, a non-transitory computer-readable storage medium stores a program for controlling a post-processing device including a post-processing section that is configured to move over a mounting section on which a medium is mounted in a width direction intersecting a transport direction of the medium and that executes post-processing on the medium mounted on the mounting section, and a driving section that moves the post-processing section in the width direction when supplied with a current or a voltage from a power supply. The program causes a computer to execute a moving step of moving the post-processing section in the width direction by supplying a set current or a set voltage set in advance from the power supply to the driving section, a holding step of holding the position of the post-processing section in the width direction by supplying, to the driving section, a supply current with the same value as a value of the set current or a supply voltage with the same value as a value of the set voltage, a stopping step of stopping the supply of the supply current or the supply voltage to the driving section, and a processing step of repeatedly executing the holding step and the stopping step and causing the post-processing section to execute the post-processing during the execution of the holding step when the post-processing section executes the post-processing on the medium a plurality of times.

According to the thirteenth aspect, it is possible to obtain the same actions and effects as those obtained by the post-processing device according to the first aspect.

First Embodiment

An example of a post-processing device, a method for controlling the post-processing device, and a program for controlling the post-processing device according to a first embodiment of the present disclosure is described below in detail.

FIG. 1 illustrates a recording system 1 that is an example of a recording device. The recording system 1 is constituted as an ink jet type device that executes recording by ejecting ink onto a paper sheet P. The paper sheet P is an example of a medium. The ink is an example of a liquid.

In an X-Y-Z coordinate system illustrated in each drawing, an X direction is a width direction of the device, a Y direction is a depth direction of the device, and a Z direction is a height direction of the device. The X, Y, and Z directions are perpendicular to each other.

When left and right sides with respect to the center in the width direction of the device when the recording system 1 is viewed from its front side are distinguished, the left side is referred to as positive X direction and the right side is referred to as negative X direction. When front and rear sides with respect to the center in the depth direction of the device are distinguished, the front side is referred to as negative Y direction and the rear side is referred to as positive Y direction. When upper and lower sides with respect to the center in the height direction of the device are distinguished, the upper side is referred to as positive Z direction and the lower side is referred to as negative Z direction. A post-processing unit 30 is described later using the foregoing directions, an A direction, and a B direction.

The recording system 1 includes a recording unit 2, an intermediate unit 4, and a post-processing unit 30 that are arranged in this order toward the positive X direction. The recording unit 2, the intermediate unit 4, and the post-processing unit 30 are mechanically and electrically coupled to each other in the recording system 1. The intermediate unit 4 transports the paper sheet P fed from the recording unit 2 to the post-processing unit 30.

In the recording system 1, an operating section 15 (FIG. 3) to be operated by an operator and a display section 17 (FIG. 3) that displays various types of information of the recording system 1 are installed. The operating section 15 is configured to input various settings of the recording unit 2 and the post-processing unit 30. The recording system 1 is configured to execute post-processing (described later) on the paper sheet P with information recorded by a printer section 10 (described later). In the recording system 1, the same actions and effects as those of the post-processing unit 30 can be obtained.

The recording unit 2 records various types of information on the transported paper sheet P. The paper sheet P is formed in a sheet-like shape. The recording unit 2 includes the printer section 10, a scanner section 12, a cassette storage section 14, and a power supply 16.

Figure 3:
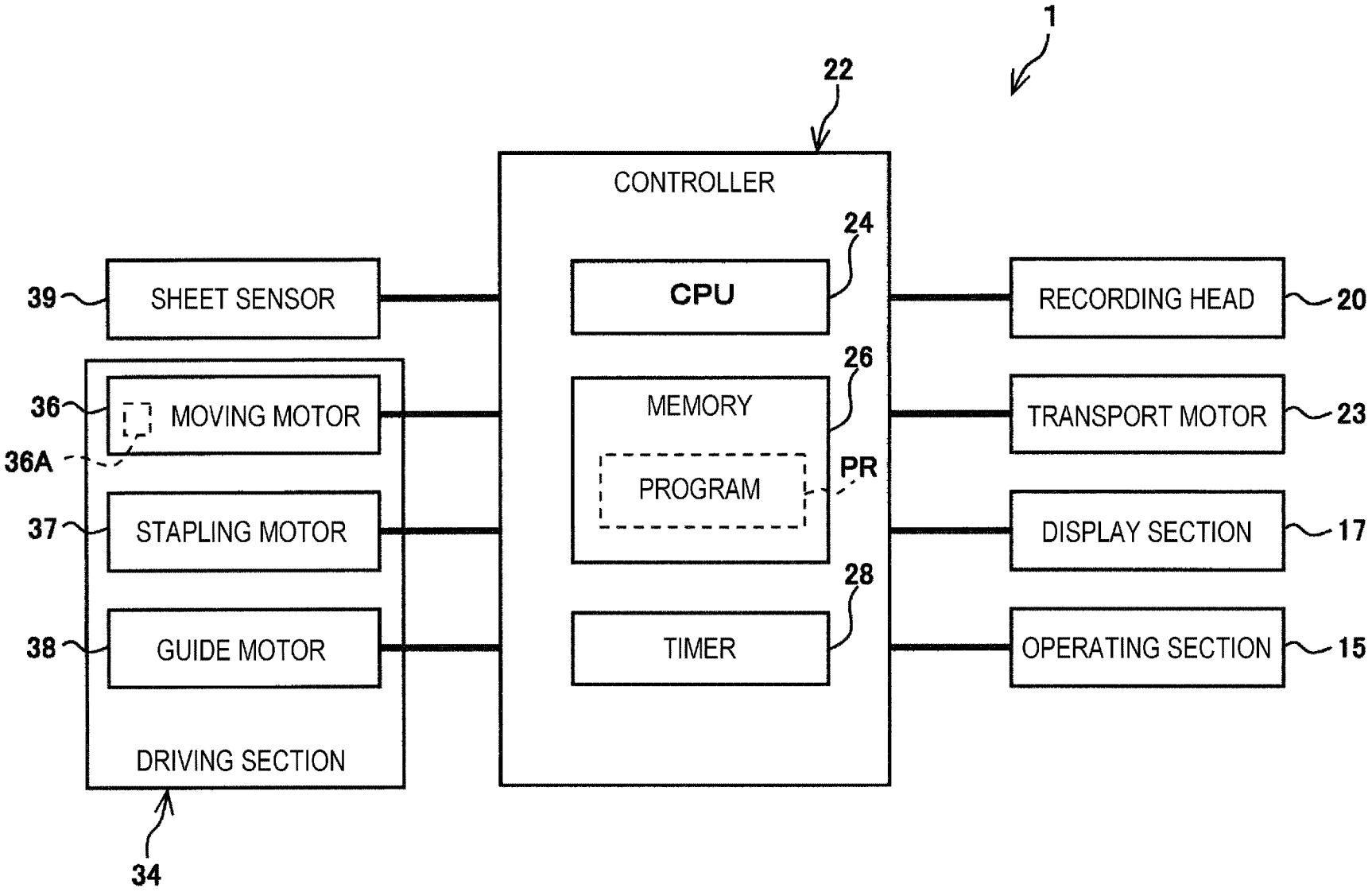
FIG. 3 is a block diagram of main sections of the recording system according to the first embodiment.

The printer section 10 is an example of a recording section and includes a recording head 20, a controller 22, and a transport motor 23 (FIG. 3).

The recording head 20 is configured as a line head as an example.

The transport motor 23 rotationally drives a plurality of pairs of rollers (not illustrated), a paddle 46 (described later), and a discharge roller 48 (described later) that are included in the recording system 1. The transport motor 23 does not mean a single motor and is a generic term for a plurality of motors. In the following description, a motor and a motor driver are collectively referred to as "motor" and an illustration and description of the motor driver are omitted.

As illustrated in FIG. 3, the controller 22 includes a central processing unit (CPU) 24 that functions as a computer, a memory 26 that functions as a storage section, a timer 28 that can measure a time period or time based on each time point, and storage (not illustrated). The controller 22 controls various operations in the recording system 1. The control by the controller 22 includes control of an operation of a stapling unit 50 (FIG. 1) (described later) and control of an operation of a driving section 34 (described later).

In the memory 26, a program PR to be executed by the CPU 24 and various data (not illustrated) are stored. The memory 26 is an example of a recording medium storing the computer-readable program PR. Other examples of the recording medium are a CD, a DVD, a Blu-ray disc, and a USB memory. The program PR can be loaded into a portion of the memory 26.

The program PR causes the CPU 24 to execute a moving step of moving the post-processing unit 30 (FIG. 1) (described later), a holding step of holding the post-processing unit 30, a stopping step, and a processing step.

As illustrated in FIG. 1, the scanner section 12 reads information of an original document (not illustrated).

The cassette storage section 14 includes a plurality of storage cassettes 18 that store a plurality of paper sheets P. In the printer section 10 and the cassette storage section 14, a transport path 19 on which a paper sheet P is transported is formed. On the transport path 19, a paper sheet P is transported from the storage cassettes 18 through a recording region of the recording head 20 and the intermediate unit 4 to the post-processing unit 30.

The post-processing unit 30 is an example of a post-processing device and collectively executes post-processing on a required number of paper sheets P received from the intermediate unit 4. In the present embodiment, as an example of the post-processing, a stapling process of stapling a plurality of paper sheets P with a staple 61 (FIG. 6) is executed. In other words, the stapling process is a process of stapling a plurality of paper sheets P with a staple 61 to form a stack Q of paper sheets. In the post-processing unit 30, a transport path K on which a paper sheet P fed from the intermediate unit 4 is transported is formed. The transport path K includes a main transport path K1 extending toward a processing tray 32 (described later) and a sub-transport path K2 extending toward an upper tray 33 (described later) as an example.

Figure 2:
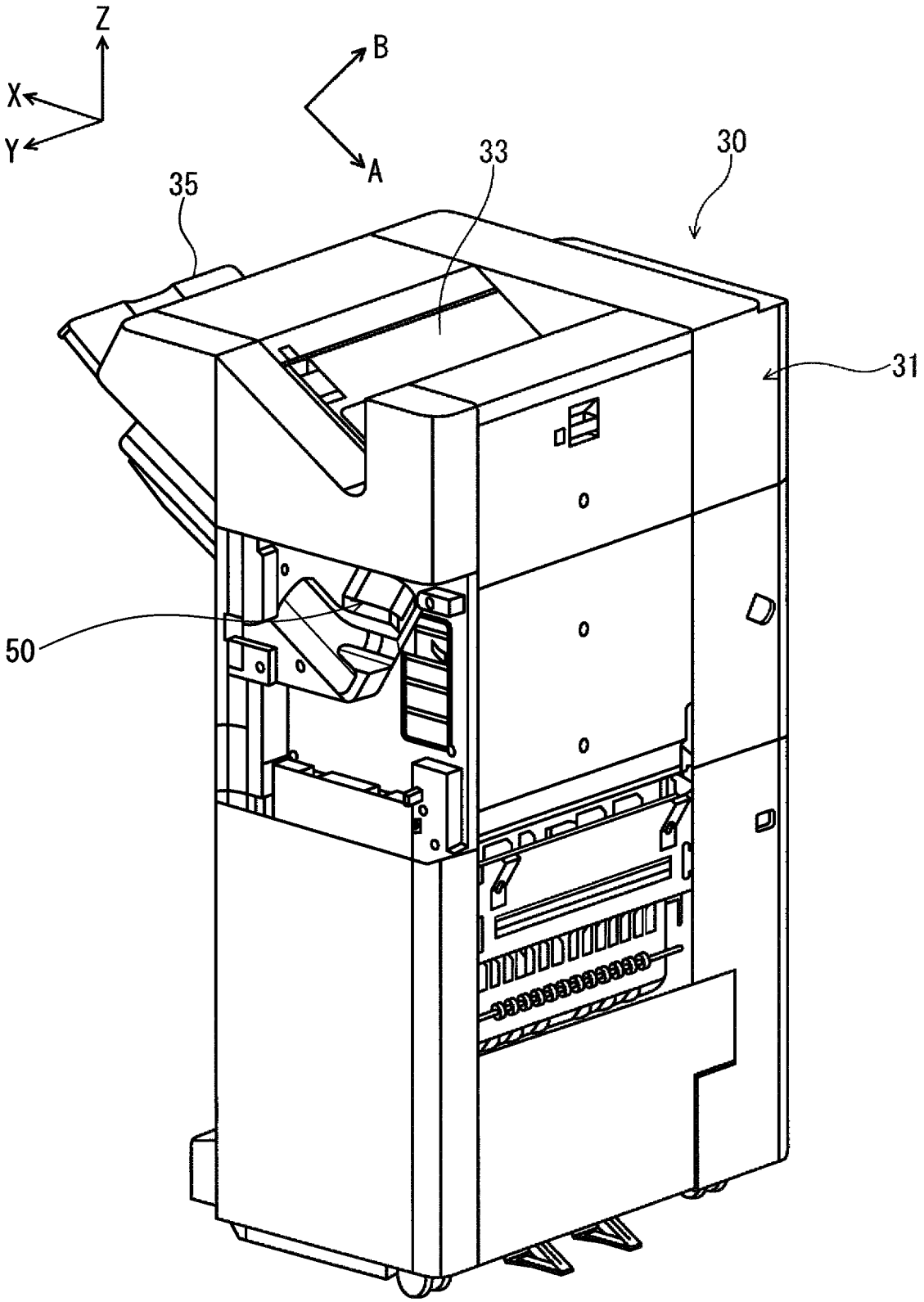
FIG. 2 is a perspective view of a post-processing unit according to the first embodiment.

As illustrated in FIG. 2, the post-processing unit 30 includes a housing 31 as a main body. The upper tray 33 is formed at an end portion of the housing 31 in the positive Z direction. A discharge tray 35 is disposed at an end portion of the housing 31 in the positive X direction, while the end portion of the housing 31 in the positive X direction is present in the positive Z direction. The upper tray 33 is inclined in such a manner that a portion of the upper tray 33 in the positive X direction is located at a higher position in the positive Z direction than a portion of the upper tray 33 in the negative X direction. The discharge tray 35 is inclined in such a manner that a portion of the discharge tray 35 in the positive X direction is located at a higher position in the positive Z direction than a portion of the discharge tray 35 in the negative X direction.

As illustrated in FIG. 1, the post-processing unit 30 includes the processing tray 32, the stapling unit 50, the driving section 34 (FIG. 3), and the controller 22 as an example. The present embodiment describes a configuration in which the controller 22 also serves as a controller of the post-processing unit 30 as an example. However, the post-processing unit 30 may include its own controller.

In the post-processing unit 30, alignment plates 42, side cursors 43 and 44 (FIG. 6), the paddle 46, and the discharge roller 48 are installed.

The processing tray 32 is an example of a mounting section. One or multiple paper sheets P transported along the main transport path K1 are mounted on the processing tray 32. The processing tray 32 has a mounting surface 32A on which one or multiple paper sheets P are mounted. The mounting surface 32A is inclined in such a manner that a portion of the mounting surface 32A in the positive X direction is located at a higher position in the positive Z direction than a portion of the mounting surface 32A in the negative X direction. A direction toward which the mounting surface 32A is inclined is referred to as A direction.

The A direction is an example of a transport direction of a paper sheet P and is perpendicular to the Y direction. The A direction intersects the X direction and the Z direction. When directions toward which the A direction extends are distinguished, a direction that extends toward the stapling unit 50 in the A direction is referred to positive A direction and a direction that extends toward the opposite side to the stapling unit 50 in the A direction is referred to as negative A direction.

The Y direction is an example of a width direction of a paper sheet P. As described above, the Y direction intersects the A direction. A direction that is perpendicular to the A direction when viewed from the Y direction is referred to as B direction. A direction toward which paper sheets P are stacked in the B direction is referred to as positive B direction, and a direction that extends toward the opposite direction to the positive B direction is referred to as negative B direction.

In the processing tray 32, a sheet sensor 39 (FIG. 3) is installed. The sheet sensor 39 is configured as an optical reflection type sensor as an example. The sheet sensor 39 detects whether a paper sheet P is present on the processing tray 32, thereby detecting whether the reception of the paper sheet P has been completed. A signal of information detected by the sheet sensor 39 is transmitted to the controller 22 (FIG. 3).

The driving section 34 is described using FIGS. 1, 3, 4, and 6. An operation of the driving section 34 is controlled by the controller 22. A current or a voltage can be supplied from the power supply 16 to the driving section 34.

The driving section 34 includes a guide motor 38, a moving motor 36, and a stapling motor 37 as an example.

The guide motor 38 includes a pinion (not illustrated) and drives the side cursors 43 and 44 (described later) in such a manner that the side cursors 43 and 44 become closer to or farther from each other in the Y direction.

The moving motor 36 is configured as a stepping motor and includes a coil 36A. In other words, the driving section 34 includes a stepping motor having the coil 36A that is excited by supplying a current to the coil 36A. The moving motor 36 includes a pinion 36B and drives transmission belts 58 and 59 (described later) to move a stapler 60 (described later) toward the positive Y direction or the negative Y direction. In other words, the driving section 34 moves the stapler 60 in the Y direction.

The stapling motor 37 drives the stapler 60 to cause the stapler 61 to staple a paper sheet P with a staple 61. Specifically, the stapling motor 37 causes the stapler 61 to execute the stapling process.

Figure 6:
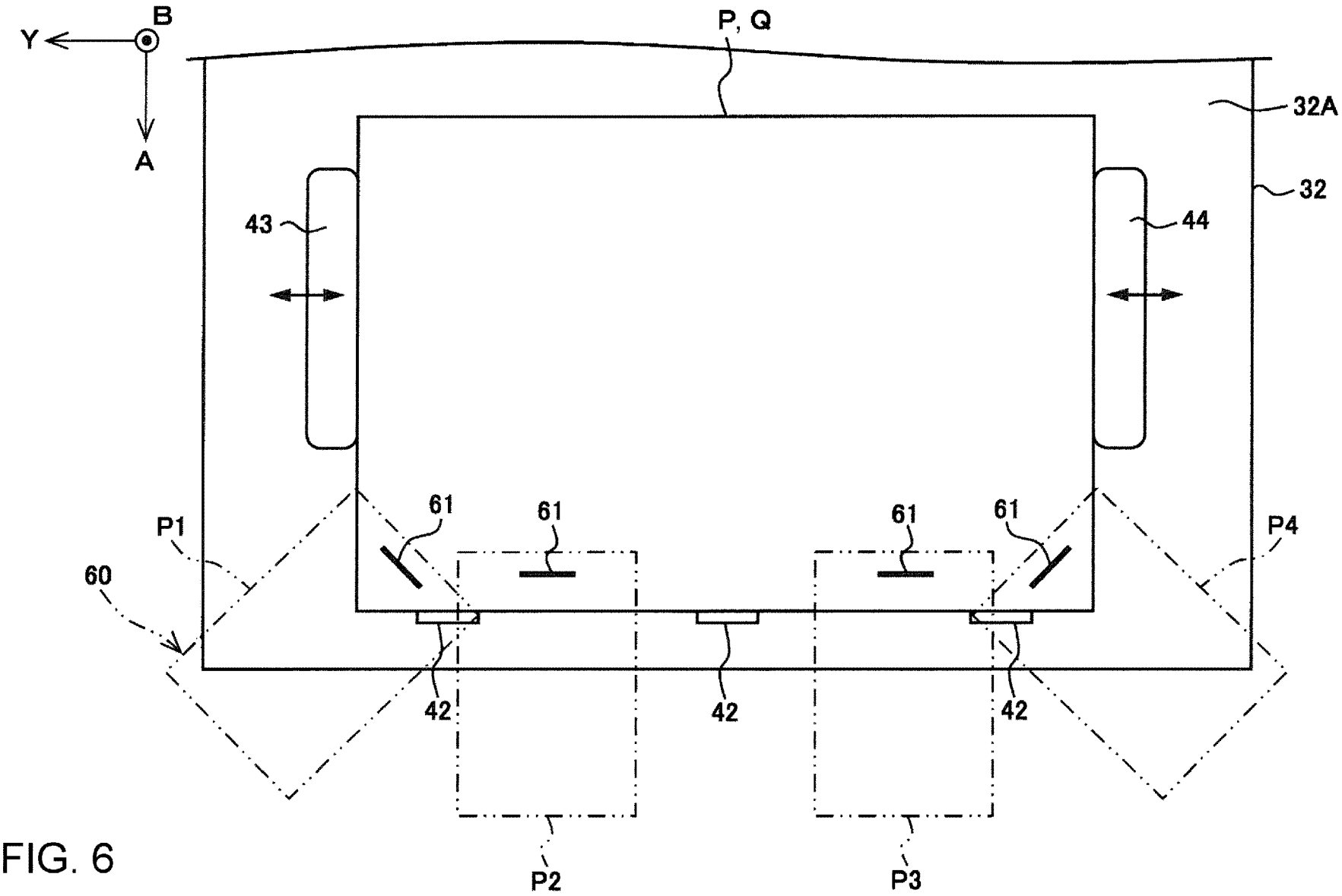
FIG. 6 is a plan view illustrating a state in which each of the post-processing unit according to the first embodiment and a post-processing unit according to a second embodiment has executed a stapling process on paper sheets.

As illustrated in FIG. 6, the alignment plates 42 stand upright in the B direction at end portions of the processing tray 32 in the positive A direction. The three alignment plates 42 are arranged at intervals in the Y direction as an example. The positions of paper sheets P in the A direction are determined or end portions of the paper sheets P are aligned due to contact of the end portions of the paper sheets P, which have been transported to the processing tray 32, in the positive A direction with the three alignment plates 42.

The side cursors 43 and 44 have a predetermined thickness in the Y direction and are formed in a plate-like shape. The side cursors 43 and 44 are arranged at an interval in the Y direction. For the side cursors 43 and 44, racks (not illustrated) are provided. The racks are moved in the Y direction via the pinion of the guide motor 38 (FIG. 3) in such a manner that the side cursors 43 and 44 move in the Y direction and become closer to or farther from each other to enable paper sheets P to be aligned.

As illustrated in FIG. 1, the paddle 46 is rotatable around its rotational axis extending in the Y direction and is installed in the housing 31. The paddle 46 is driven by the transport motor 23 (FIG. 3) to transport a paper sheet P to the processing tray 32.

The discharge roller 48 is arranged downstream of the paddle 46 in the negative A direction. The discharge roller 48 is rotatable around its rotational axis extending in the Y direction and is installed in the housing 31. The discharge roller 48 is driven by the transport motor 23 to discharge a paper sheet P on the processing tray 32 or a stack Q of paper sheets on the processing tray 32 to the discharge tray 35.

Figure 4:
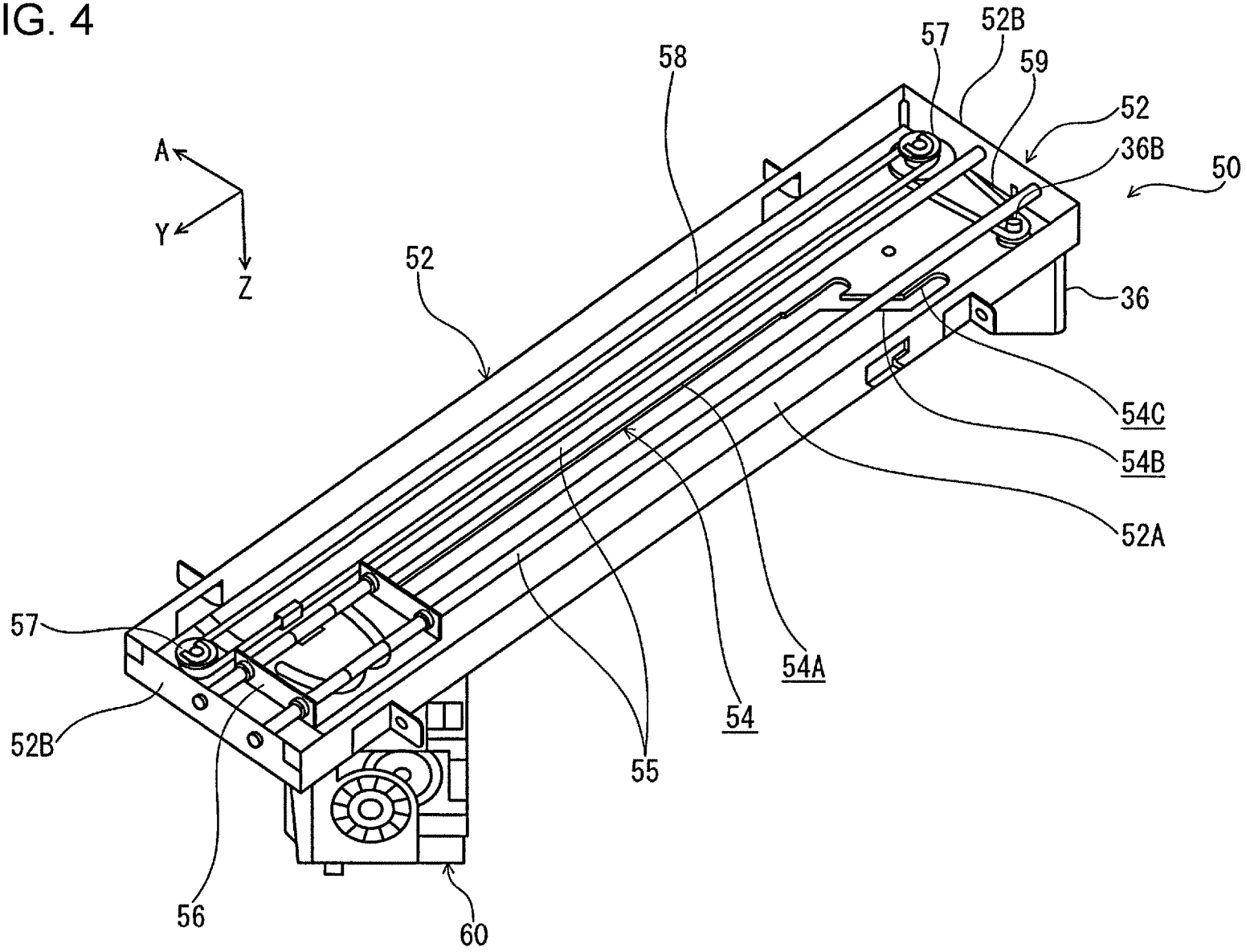
FIG. 4 is a perspective view of a stapling unit according to the first embodiment when viewed from the bottom of the stapling unit.

As illustrated in FIG. 4, as an example, the stapling unit 50 includes a base frame 52, guide shafts 55, a movable frame 56, two pulleys 57, the transmission belts 58 and 59, and the stapler 60. The stapling unit 50 is arranged in the positive A direction with respect to the processing tray 32 (FIG. 1).

The base frame 52 is opened in the negative Z direction and formed in a box-like shape. The base frame 52 includes an upper plate portion 52A extending along an A-Y plane and side walls 52B facing each other in the Y direction. The upper plate portion 52A extends in the Y direction. A guide hole portion 54 is formed in the upper plate portion 52A. In addition, the moving motor 36 is disposed on the upper plate portion 52A.

The guide hole portion 54 includes a first hole portion 54A, a second hole portion 54B, and a third hole portion 54C. The guide hole portion 54 is formed symmetrically with respect to the center in the Y direction. The first hole portion 54A extends in the Y direction. The second hole portion 54B extends in a direction intersecting and oblique to the Y direction from both end portions of the first hole portion 54A in the Y direction. In addition, the second hole portion 54B extends toward a position located in the negative A direction. The third hole portion 54C extends in the Y direction from both end portions of the second hole portion 54B toward the outer side.

The guide shafts 55 extend in the Y direction and are disposed between the side walls 52B.

The movable frame 56 is held by the guide shafts 55 and can move along the guide shafts 55 in the Y direction. The stapler 60 is disposed on the movable frame 56 in such a manner that the stapler 60 can move relatively to the movable frame 56.

The two pulleys 57 are disposed on the base frame 52. The transmission belt 59 is wound around one of the pulleys 57 and the pinion 36B.

The transmission belt 58 is wound around the two pulleys 57. The movable frame 56 is fixed to a portion of the transmission belt 58.

The pinion 36B is rotated forward or backward to cause the movable frame 56 to linearly move toward the positive Y direction or the negative Y direction. In other words, the stapler 60 is moved toward the positive Y direction or the negative Y direction.

Figure 5:
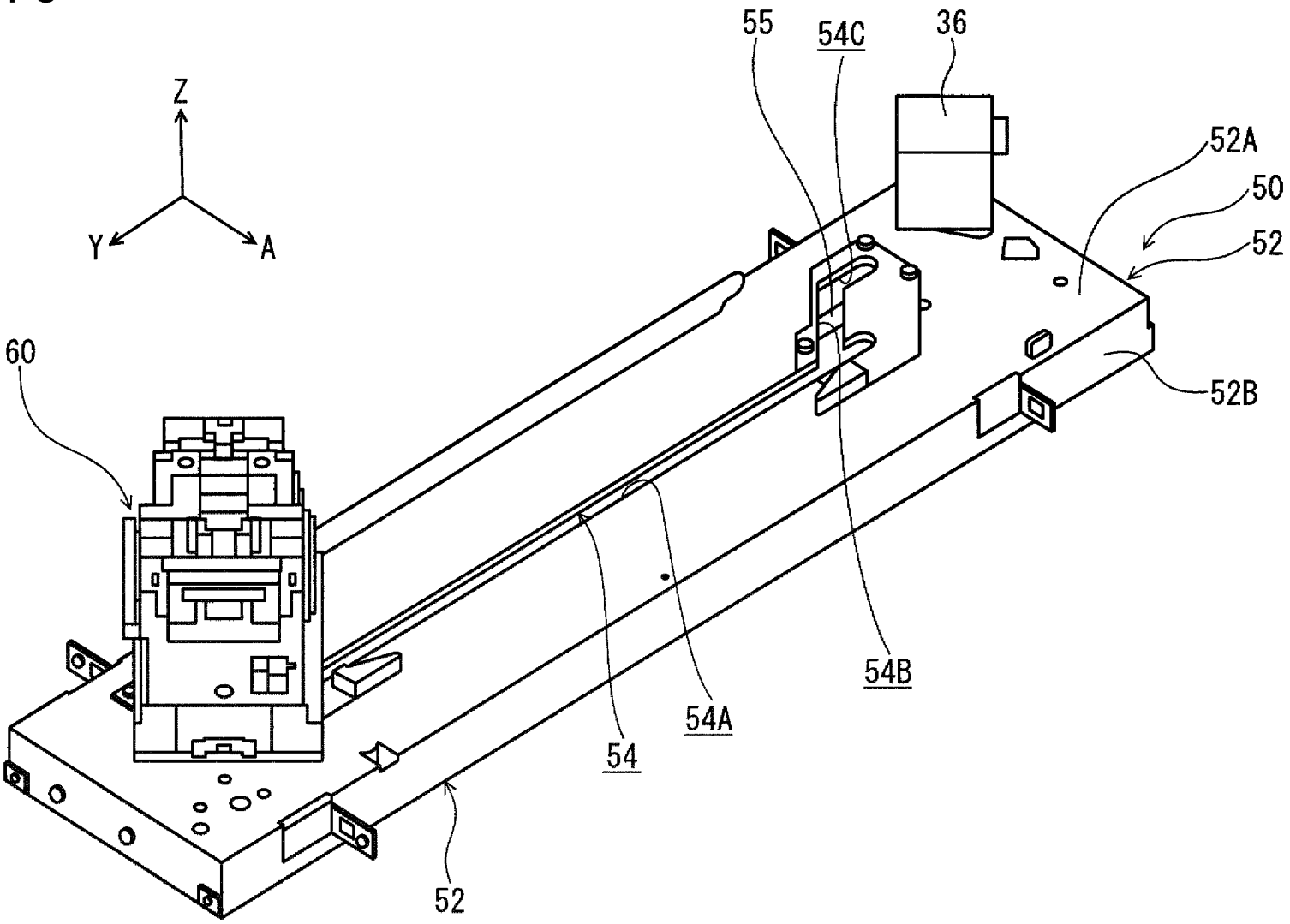
FIG. 5 is a perspective view of the stapling unit according to the first embodiment when viewed from the top of the stapling unit.

The stapler 60 is an example of a stapling section and an example of a post-processing section. As illustrated in FIG. 5, the stapler 60 is arranged in the positive Z direction with respect to the upper plate portion 52A. When the stapler 60 is moved to an end portion of the first hole portion 54A in the Y direction, the stapler 60 enters in the second hole portion 54B while rotating and is oriented toward a direction intersecting the Y direction.

The position of the stapler 60 at an end portion of the base frame 52 in the positive Y direction and the position of the stapler 60 at an end portion of the base frame 52 in the negative Y direction are axisymmetric with respect to a straight line (not illustrated) extending in the A direction through the center in the Y direction.

The stapler 60 includes a moving section (not illustrated), a staple 61 (FIG. 6), and a stapling motor 37 (FIG. 3). The staple 61 is an example of a staple. The stapling motor 37 is operated by supplying a current to the stapling motor 37 and drives the moving section to cause the stapler 60 to staple portions of a plurality of paper sheets P with the staple 61. In other words, the stapler 60 executes the stapling process on a plurality of paper sheets P to staple the paper sheets P by supplying a current. The stapler 60 is provided in such a manner that the stapler 60 can move in the Y direction. The stapler 60 executes the stapling process on a plurality of paper sheets P mounted on the processing tray 32 to form one stack Q of the paper sheets (FIG. 1). The stapling process is an example of post-processing.

As illustrated in FIG. 6, the stapler 60 can be located at four positions relative to a paper sheet P when viewed from the B direction as an example. In FIG. 6, the four positions PA, PB, PC, and PD of the stapler 60 are indicated by virtual lines P1, P2, P3, and P4 indicating an outer shape of the stapler 60. FIG. 6 illustrates a paper sheet P when viewed from the back side.

Figure 7B:
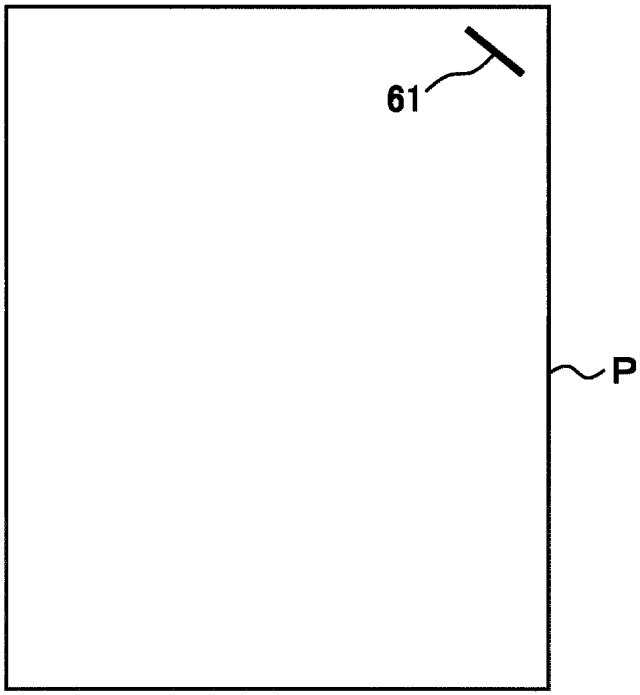
FIG. 7B is a schematic diagram illustrating a state in which the post-processing unit according to the first embodiment has executed the stapling process on upper left portions of paper sheets when viewed from the back side of the paper sheets.
Figure 7A:
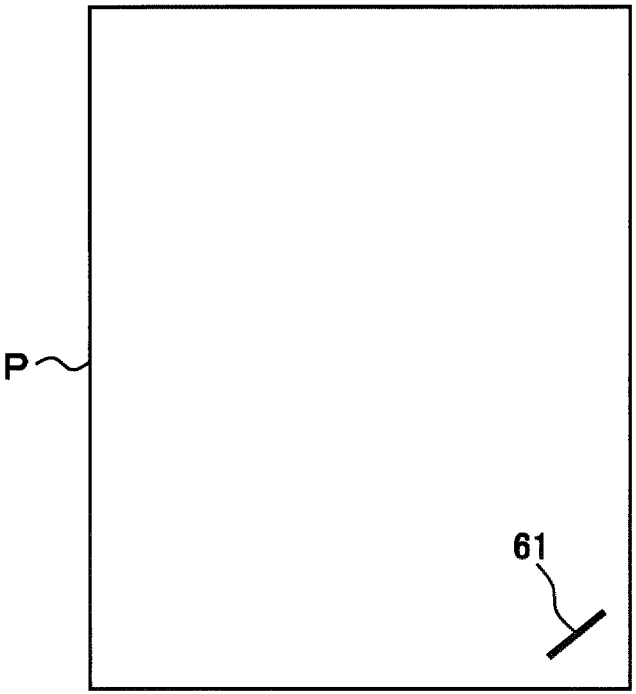
FIG. 7A is a schematic diagram illustrating a state in which the post-processing unit according to the first embodiment has executed a stapling process on upper right portions of paper sheets when viewed from the back side of the paper sheets.

The stapler 60 executes the stapling process on upper right portions of paper sheets P at the position P1. Specifically, the stapler 60 staples the upper right portions of the paper sheets P with a staple 61 (FIG. 7A).

In addition, the stapler 60 executes the stapling process on upper left portions of the paper sheets P at the position P4. Specifically, the stapler 60 staples the upper left portions of the paper sheets P with a staple 61 (FIG. 7B).

Furthermore, after the stapler 60 executes the stapling process at the position P2, the stapler 60 is moved to the position P3 in the Y direction and executes the stapling process to staple end portions of the paper sheets P in the positive A direction with two staples 61 in such a manner that the two staples 61 are arranged at an interval in the Y direction.

The first embodiment describes an example in which the stapler 60 executes the stapling process on a plurality of paper sheets P at the position P4.

Control set in advance in the controller 22 illustrated in FIG. 3 is described below. In other words, various types of control to be executed by the controller 22 are described below. Sections of the post-processing unit 30 are described with reference to FIGS. 1 to 6, and a description of the individual figure numbers is omitted.

The controller 22 can execute first control, second control, and third control.

The first control is to supply a set current Ia or a set voltage Va set in advance from the power supply 16 to the moving motor 36 of the driving section 34 to cause the moving motor 36 to move the stapler 60 in the Y direction. An illustration of the set current Ia and the set voltage Va is omitted.

The second control is to supply a supply current Ib with the same value as a value of the set current Ia or a supply voltage Vb with the same value as a value of the set voltage Va to the moving motor 36 of the driving section 34 to cause the moving motor 36 to hold the position of the stapler 60 in the Y direction. An illustration of the supply current Ib and the supply voltage Vb is omitted.

The third control is to stop the supply of the supply current Ib or the supply voltage Vb to the moving motor 36 of the driving section 34.

A state in which the value of the set current Ia is the same as the value of the supply current Ib includes not only a state in which Ia=Ib but also a state in which one of the values of the currents Ia and Ib is in a measurement error range of the other. Similarly, a state in which the value of the set voltage Va is the same as the value of the supply voltage Vb includes not only a state in which Va=Vb but also a state in which one of the values of the voltages Va and Vb is in a measurement error range of the other. In the execution of the program PR, the first control corresponds to the moving step, the second control corresponds to the holding step, and the third control corresponds to the stopping step.

When the stapler 60 executes the stapling process on paper sheets P a plurality of times, the controller 22 repeatedly executes the second control and the third control and causes the stapler 60 to execute the stapling process during the execution of the second control. This control corresponds to the processing step in the execution of the program PR.

When the stapling process is executed a plurality of times at one set position on paper sheets P in the Y direction, the controller 22 repeatedly executes the second control and the third control without executing the first control.

The controller 22 synchronizes an operation of the stapler 60 to execute the stapling process with an operation of the driving section 34 using, as a reference time point, a time point when a signal is input before the start of the operation of the stapler 60 to execute the stapling process. In the present embodiment, as an example of the reference time point, a time point when a signal transmitted from the sheet sensor 39 when the reception of a paper sheet P on the processing tray 32 of the post-processing unit 30 is terminated is input is set.

At a time point t9 that is before a time point t10 when the operation of executing the stapling process is started, the controller 22 starts supplying the supply current Ib or the supply voltage Vb to the moving motor 36 of the driving section 34.

When a set time period ΔT (seconds) (FIG. 8) (described later) elapses after the start time of the supply of the supply current Ib or the supply voltage Vb to the moving motor 36 of the driving section 34, the controller 22 stops the supply of the current or the voltage to the moving motor 36 from the power supply 16. When a set elapsed time period Δt1 (seconds) (FIG. 8) elapses after the end time of the operation of the stapler 60 to execute the stapling process, the controller 22 stops the supply of the current or the voltage to the moving motor 36 of the driving section 34 from the power supply 16.

In the last stapling process among the plurality of times of the stapling process, the controller 22 causes the stapler 60 to execute the stapling process without executing the second control.

When the number of times that the stapling process is executed on one portion of a paper sheet P is 1, the controller 22 causes the stapler 60 to execute the stapling process without executing the second control.

Settings for operations of the sections of the post-processing unit 30 are described using timing charts. The sections of the post-processing unit 30 are described with reference to FIGS. 1 to 6, and a description of the individual figure numbers is omitted.

Figure 8:
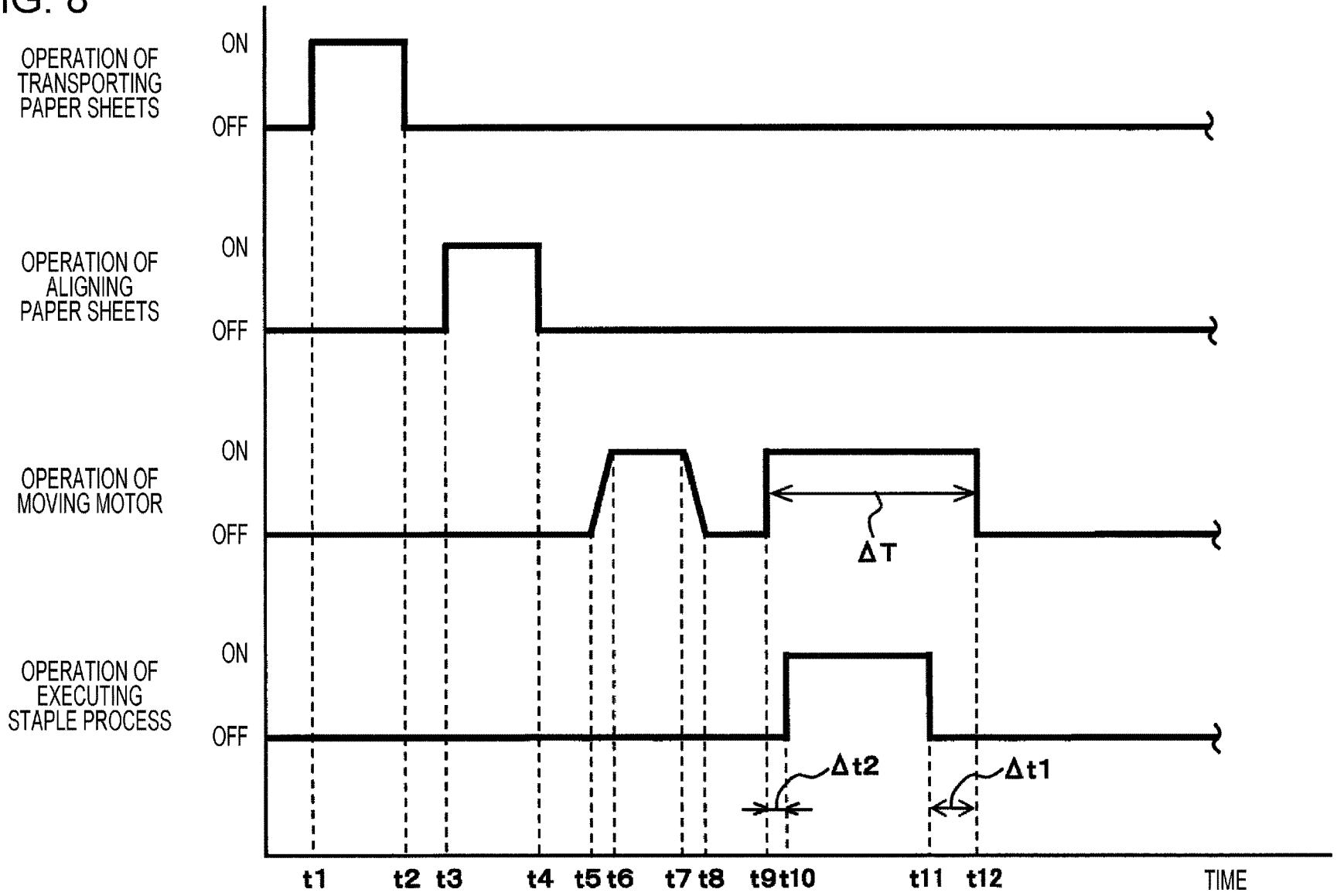
FIG. 8 is a timing chart illustrating an operation of transporting paper sheets, an operation of aligning the paper sheets, an operation of a moving motor, and an operation of a stapler to execute the stapling process in the post-processing unit according to the first embodiment at each time point.

FIG. 8 is a timing chart illustrating time points when an operation of transporting paper sheets P, an operation of aligning the paper sheets P, an operation of the moving motor 36, and an operation of executing the stapling process are on or off. The operations illustrated in FIG. 8 are operations to be executed until the stapling process is terminated and one stack Q of the paper sheets is formed. FIG. 8 illustrates a time period from a time point t1 through time points t2 to t11 to a time point t12. Intervals between the time points t1 to t12 or lengths of time periods between the time points t1 to t12 are schematically illustrated and may be different from actual lengths of time periods between the time points t1 to t12.

The operation of transporting the paper sheets P includes an operation of using the paddle 46 to transport the paper sheets P and an operation of using the discharge roller 48 to discharge the stack Q of paper sheets. The operation of transporting the paper sheets P by the paddle 46 is started at the time point t1 and terminated at the time point t2.

The operation of aligning the paper sheets is an operation of using the side cursors 43 and 44 to align end portions of the plurality of paper sheets P in the Y direction. The operation of aligning the plurality of paper sheets P is started at the time point t3 and terminated at the time point t4.

In the time period from the time point t1 to the time point t2, the plurality of paper sheets P may be transported by the paddle 46 to the processing tray 32 and aligned by the side cursors 43 and 44.

In the operation of the moving motor 36, the set current Ia or the set voltage Va is supplied to the moving motor 36 at the time point t5, and the stapler 60 starts moving at the time point t6. The supply of the set current Ia or the set voltage Va to the moving motor 36 is stopped at the time point t7, and the stapler 60 is stopped moving at the time point t8.

The supply current Ib or the supply voltage Vb is supplied to the moving motor 36 at the time point t9. The supply of the supply current Ib or the supply voltage Vb is stopped at the time point t12. In other words, in a time period from the time point t9 to the time point t12, the moving motor 36 resists external force in such a manner that the moving motor 36 does not rotate and thus the position of the stapler 60 in the Y direction is held.

As an example, the time point t9 is set as a time point when a time period set in advance elapses after the time point t8 as a reference time point. As an example, the time point t12 is set as a time point when a time period set in advance elapses after the time point t11 as a reference time point. The time period from the time point t9 to the time point t12 corresponds to the set time period ΔT.

The operation of executing the stapling process is an operation of stapling a plurality of paper sheets P by the stapler 60 with a staple 61. The operation of executing the stapling process is started at the time point t10 and terminated at the time point t1*l*. As an example, the time point t10 is set as a time point when a time period set in advance elapses after the time point t8 as a reference time point.

In the present embodiment, as an example, in a time period for which the position of the stapler 60 in the Y direction is held, the operation of executing the stapling process is executed.

The time period from the time point t11 to the time point t12 corresponds to the first time period Δt1. The time period from the time point t9 to the time point t10 corresponds to a second time period Δt2 (seconds).

Regarding the post-processing unit 30, the first time period Δt1 from the end time of the stapling process to the end time of the second control is longer than the second time period Δt2 from the start time of the second control to the start time of the stapling process. The first time period Δt1 is an example of a set elapsed time period.

In addition, regarding the post-processing unit 30, force that acts on the stapler 60 in the Y direction when the stapler 60 staples paper sheets P is larger than holding force caused by detent torque when the coil 36A of the moving motor 36 is not excited.

Figure 9:
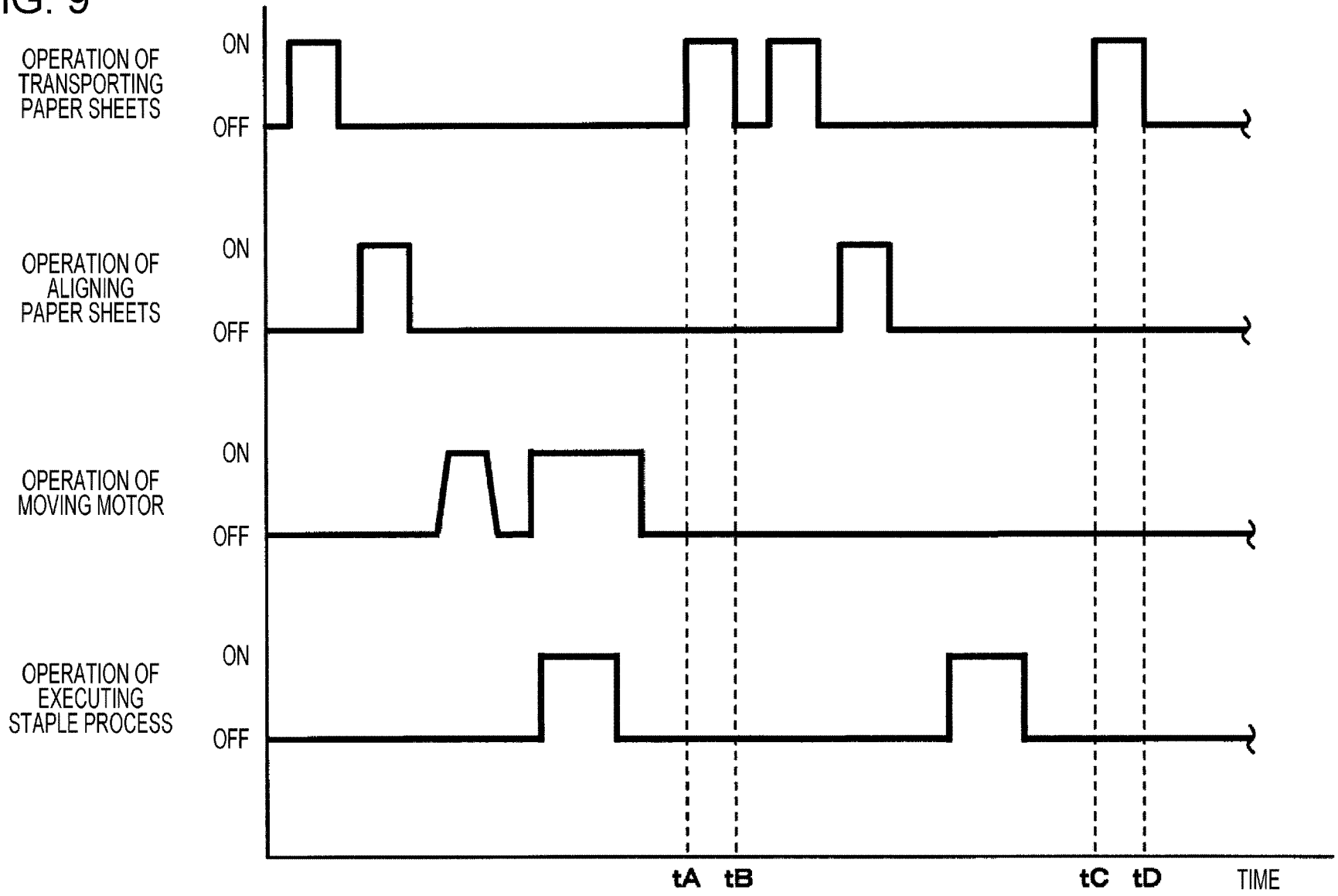
FIG. 9 is a timing chart illustrating the case where the post-processing unit according to the first embodiment continuously executes the stapling process on two stacks of paper sheets.

FIG. 9 is a timing chart illustrating the case where the operations illustrated in FIG. 8 are continuously executed on two stacks Q of paper sheets as an example. For the operations described above, an illustration and description of time points are omitted. In the present embodiment, the second stack Q of paper sheets corresponds to the last stack of media.

After the stapling process is executed on the first stack Q of paper sheets, the discharge of the stack Q of paper sheets is started by the discharge roller 48 at a time point tA and terminated at a time point tB. Subsequently, an operation of transporting the next paper sheets P and an operation of aligning the next paper sheets P are executed. However, since a position where the stapling process is executed on the paper sheets P is not changed and thus the moving motor 36 does not operate and does not execute holding. After the stapling process is executed in this state, the discharge of the stack Q of paper sheets is started by the discharge roller 48 at a time point tC and terminated at a time point tD. In this manner, the stapling process is executed once on each of the two stacks of paper sheets Q.

Next, actions of the post-processing unit 30 according to the first embodiment are described. The sections of the post-processing unit 30 are described with reference to FIGS. 1 to 6, and a description of the individual figure numbers is omitted.

Figure 10:
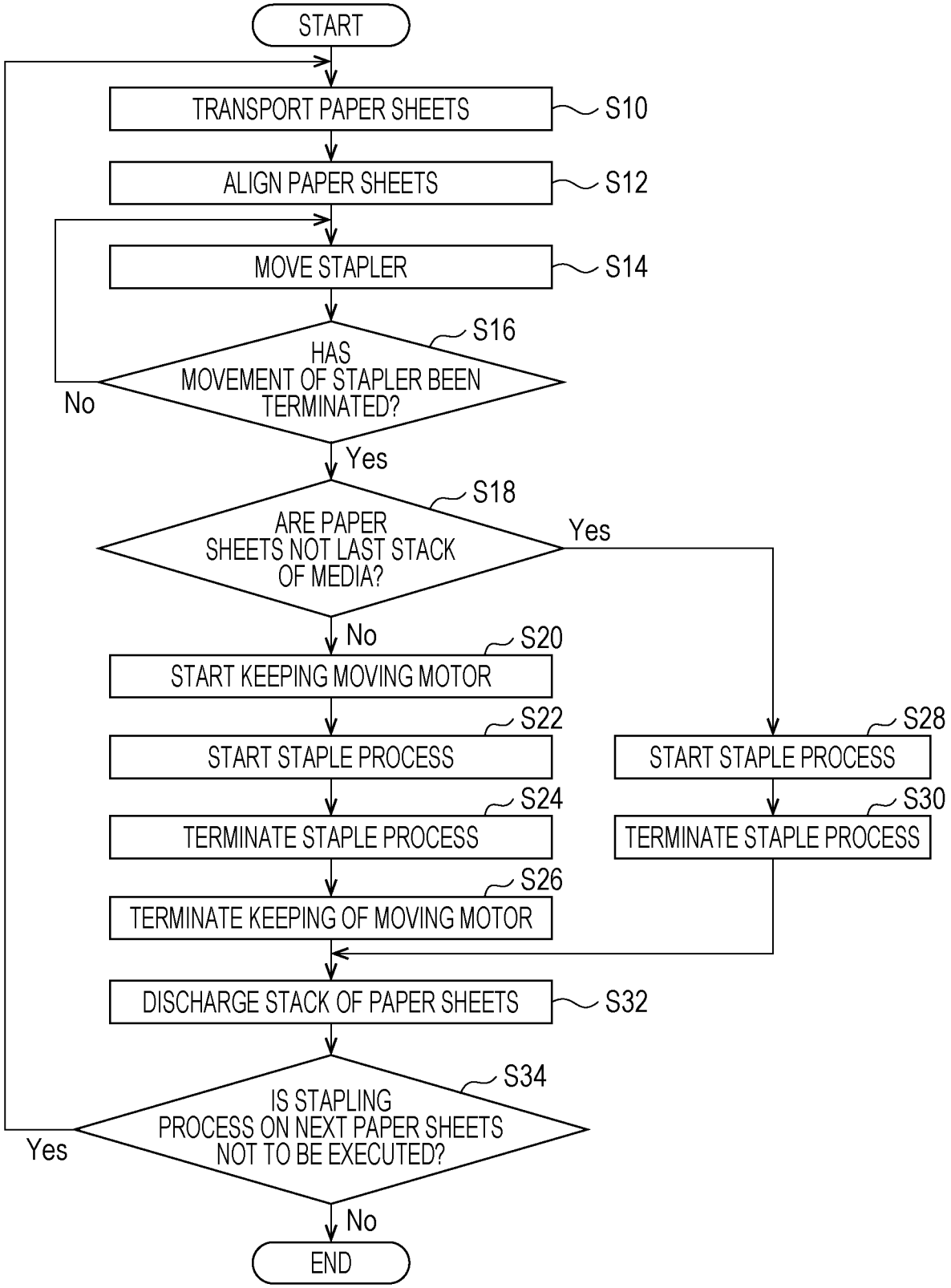
FIG. 10 is a flowchart illustrating a procedure for processes to be executed by the post-processing unit according to the first embodiment.

FIG. 10 is a flowchart illustrating a procedure for processes from a process of receiving paper sheets P by the controller 22 to a process of discharging a stack Q of the paper sheets after the stapling process. The CPU 24 reads the program PR from the memory 26 and loads and executes the program PR, thereby executing the processes illustrated in FIG. 10.

In step S10, the CPU 24 causes the paddle 46 to operate and transport a plurality of paper sheets P to the processing tray 32. Then, the process procedure proceeds to step S12.

In step S12, the CPU 24 causes the guide motor 38 to operate and move the side cursors 43 and 44, thereby causing the side cursors 43 and 44 to align the plurality of paper sheets P. Then, the process procedure proceeds to step S14.

In step S14, the CPU 24 causes the moving motor 36 to operate and move the stapler 60 from an initial position to the position P4. Then, the process procedure proceeds to step S16.

In step S16, the CPU 24 determines whether the movement of the stapler 60 in the Y direction has been terminated. As an example, the CPU 24 determines, based on a time period that has elapsed after the start of the movement of the stapler 60, whether the stapler 60 has reached the position P4. When the stapler 60 has reached the position P4 (Yes in S16), the process procedure proceeds to step S18. When the stapler 60 has not reached the position P4 (No in S16), the process procedure proceeds to step S14.

In step S18, the CPU 24 determines whether the plurality of paper sheets P to be subjected to the stapling process are not the last stack Q of paper sheets. When the plurality of paper sheets P are not the last stack Q of paper sheets (No in S18), the process procedure proceeds to step S20. When the plurality of paper sheets P are the last stack Q of paper sheets (Yes in S18), the process procedure proceeds to step S28.

In step S20, the CPU 24 supplies the supply current Ib or the supply voltage Vb to the moving motor 36 to keep the moving motor 36 in such a manner that the moving motor 36 does not rotate. Then, the process procedure proceeds to step S22.

In step S22, the CPU 24 causes the stapling motor 37 to operate to cause the stapler 60 to operate and start the stapling process. Then, the process procedure proceeds to step S24.

In step S24, the CPU 24 stops the operation of the stapling motor 37, thereby stopping the operation of the stapler 60. Then, the process procedure proceeds to step S26.

In step S26, the CPU 24 stops the supply of the supply current Ib or the supply voltage Vb to the moving motor 36. This terminates the keeping of the moving motor 36. Then, the process procedure proceeds to step S32.

In step S28, the CPU 24 causes the stapling motor 37 to operate to cause the stapler 60 to operate and start the stapling process. Then, the process procedure proceeds to step S30.

In step S30, the CPU 24 stops the operation of the stapling motor 37, thereby stopping the operation of the stapler 60. Then, the process procedure proceeds to step S32.

In step S32, the CPU 24 causes the transport motor 23 to operate to cause the discharge roller 48 to rotate and discharge the stack Q of paper sheets. Then, the process procedure proceeds to step S34.

In step S34, the CPU 24 determines whether the stapling process on the next paper sheets P is to be executed. As an example, the determination is made based on a difference between a set number of stacks Q of paper sheets and the number of stacks Q of paper sheets discharged. When the stapling process on the next paper sheets P is not to be executed (No in step S34), the program PR is terminated. When the stapling process on the next paper sheets P is to be executed (Yes in step S34), the process procedure proceeds to step S10.

Figures 11A, 11B, 11C:
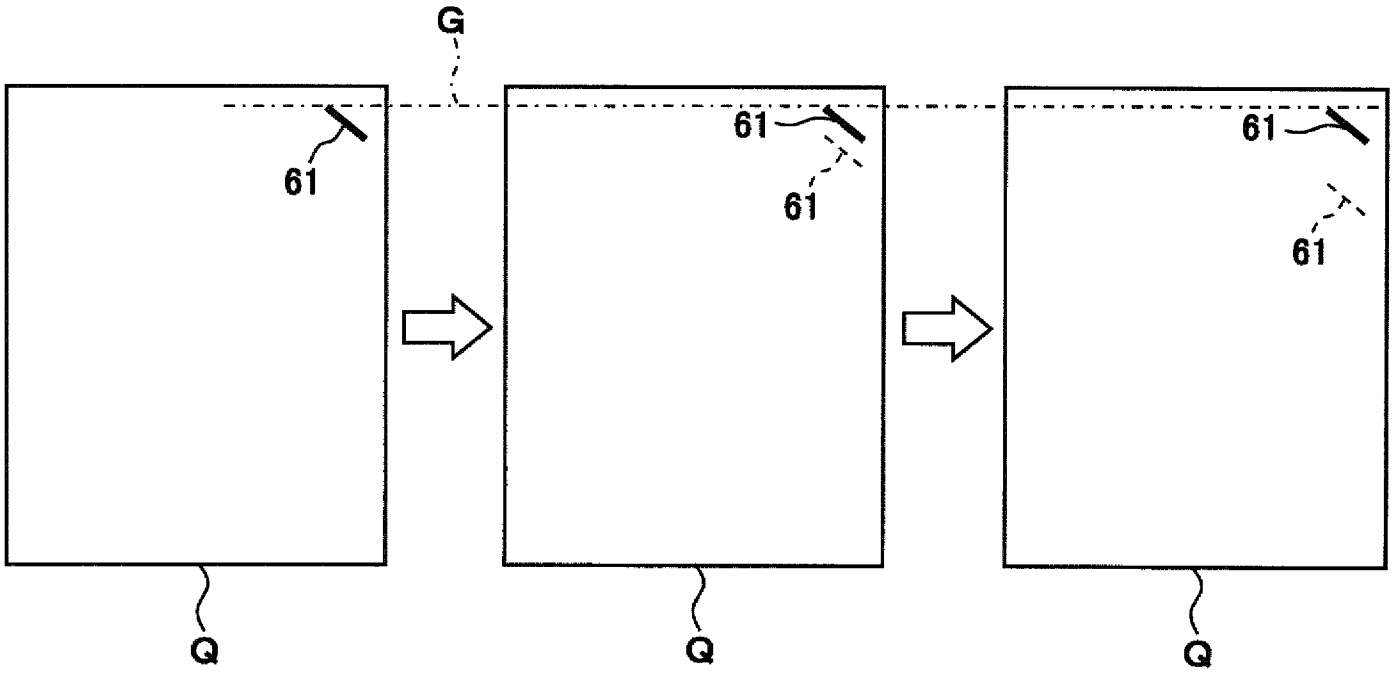
FIG. 11A is a schematic diagram illustrating a state in which the stapling process has been executed by the post-processing unit according to the first embodiment on an upper left portion of the first stack of paper sheets.
FIG. 11B is a schematic diagram illustrating, together with a comparative example, a state in which the stapling process has been executed on an upper left portion of the fortieth stack of paper sheets.
FIG. 11C is a schematic diagram illustrating, together with the comparative example, a state in which the stapling process has been executed on an upper left portion of the eightieth stack of paper sheets.

FIG. 11A illustrates a state in which the post-processing unit 30 (FIG. 1) has stapled the first stack Q of paper sheets with a staple 61 at upper left portions of the paper sheets. FIG. 11B illustrates a state in which the post-processing unit 30 (FIG. 1) has stapled the fortieth stack Q of paper sheets with a staple 61 at upper left portions of the paper sheets. FIG. 11C illustrates a state in which the post-processing unit 30 (FIG. 1) has stapled the eightieth stack Q of paper sheets with a staple 61 at upper left portions of the paper sheets. The staples 61 indicated by solid lines are used to staple the paper sheets by the post-processing unit 30, while staples 61 indicated by broken lines are used to staple the paper sheets by a device according to a comparative example in which a moving motor 36 is not kept based on a supply current Ib or a supply voltage Vb.

In the device according to the comparative example, as stapling is progressed in order from the first stack of paper sheets through the fortieth stack of paper sheets to the eightieth stack of paper sheets, a deviation of the position of a staple 61 from a dashed-and-dotted line G indicating a predetermined stapling position becomes larger.

On the other hand, in the post-processing unit 30 according to the present embodiment, even when stapling is progressed in order from the first stack of paper sheets through the fortieth stack of paper sheets to the eightieth stack of paper sheets, a deviation of the position of a staple 61 from a predetermined stapling position is smaller than that in the comparative example.

As described above, according to the post-processing unit 30, the set current Ia and the supply current Ib are the same or the set voltage Va and the supply voltage Vb are the same in the first control and the second control, and thus a converter that changes the magnitude of output of the supply current Ib or the supply voltage Vb to be supplied to the driving section 34 is not required. For example, a DC-DC converter is not required. Therefore, the configuration of the post-processing unit 30 can be simplified.

In addition, since the supply current Ib or the supply voltage Vb that has the same value as the set current Ia or the set voltage Va is supplied to the driving section 34, the stapling process is executed by the stapler 60 in a state in which force to hold the position of the stapler 60 is increased. Therefore, even when a component of impact force caused by the operation of executing the stapling process acts on the stapler 60, it is possible to suppress a deviation of the position of the stapler 60 in the Y direction.

In the method for controlling the post-processing unit 30 and the program PR of the post-processing unit 30, the same actions and effects as those of the post-processing unit 30 can be obtained.

According to the post-processing unit 30, the first control is not executed in the stapling process executed a plurality of times and thus it is possible to increase a speed at which the stapling process is executed, compared to a configuration in which the first control is executed every time the stapling process is to be executed.

According to the post-processing unit 30, the operation of the stapler 60 to execute the stapling process is synchronized with the operation of the driving section 34, and an extra supply current Ib or an extra supply voltage Vb is hardly supplied, compared to a configuration in which the foregoing operations are not synchronized. Therefore, it is possible to reduce power to be consumed by the post-processing unit 30.

When a time period required to align a plurality of paper sheets P changes, the start time t10 (FIG. 8) of the stapling process changes from the time point set in advance. Specifically, the time point t4 (FIG. 8) when the alignment is terminated may deviate to a time point before or after the set time point depending on a mounted state of a plurality of paper sheets P and the time point t10 may deviate from the set time point to a time point before or after the set time point due to the deviation of the time point t4. As described above, in the post-processing unit 30 according to the first embodiment, the operation of executing the stapling process is synchronized with the operation of the driving section 34. Therefore, even when the time point t4 when the alignment is terminated deviates to a time point before or after the set time point, an extra supply current Ib or an extra supply voltage Vb is hardly supplied and it is possible to reduce power to be consumed by the post-processing unit 30.

According to the post-processing unit 30, the moving motor 36 starts the holding at the time point t9 before the time point t10 when the operation of executing the stapling process is started, and force to hold the stapler 60 by the moving motor 36 is increased. Therefore, when the stapling process is executed by the stapler 60, it is possible to suppress a deviation of the position of the stapler 60 in the Y direction.

According to the post-processing unit 30, when the set time period Δt elapses after the time point t9 that is the start time of the supply of the supply current Ib or the supply voltage Vb to the moving motor 36 of the driving section 34, the supply of the current or the voltage to the driving section 34 from the power supply 16 is stopped. Therefore, it is possible to further reduce power to be consumed by the post-processing unit 30, compared to a configuration in which the current or the voltage is supplied to the driving section 34 for a time period longer than the set time period Δt.

According to the post-processing unit 30, when the set elapsed time period Δt1 elapses after the end time t11 of the operation of the stapler 60 to execute the stapling process, the supply of the current or the voltage to the moving motor 36 of the driving section 34 from the power supply 16 is stopped. Therefore, it is possible to further reduce power to be consumed by the post-processing unit 30, compared to a configuration in which the current or the voltage is supplied to the driving section 34 for a time period longer than the set elapsed time period Δt1.

According to the post-processing unit 30, the holding of the position of the stapler 60 is released after the termination of the operation of the stapler 60. Therefore, it is possible to suppress a deviation of the position of the stapler 60 in the Y direction, while reducing power to be consumed by the post-processing unit 30.

Since the stapling process is not executed after the last stapling process, a problem does not occur even when the position of the stapler 60 deviates in the Y direction. According to the post-processing unit 30, since the number of times that the second control is executed is reduced by 1, it is possible to reduce power to be consumed by the post-processing unit 30, compared to a configuration in which the second control is executed every time the stapling process that is executed a plurality of times is to be executed.

When the number of times that the stapling process is executed on one portion of a paper sheet P is 1, no stapling process is executed after the stapling process executed once. Therefore, a problem does not occur even when the position of the stapler 60 deviates in the Y direction. In this case, the second control is not executed and thus it is possible to reduce power to be consumed by the post-processing unit 30, compared to a configuration in which the second control is executed when the stapling process is to be executed once.

According to the post-processing unit 30, since force that acts on the stapler 60 in the Y direction increases, it is possible to easily move the stapler 60 in the Y direction as a result.

Second Embodiment

Next, an example of a post-processing device, a method for controlling the post-processing device, and a program for controlling the post-processing device according to a second embodiment of the present disclosure is described in detail. Sections that are common to the first embodiment are indicated by the same reference signs as those described in the first embodiment, and a description thereof and a description of the individual figure numbers are omitted.

A post-processing unit 30 according to the second embodiment is different from the post-processing unit 30 according to the first embodiment in that a stapler 60 executes a stapling process at two positions P2 and P3. The position P2 is an example of a first position. The position P3 is an example of a second position.

In the post-processing unit 30 illustrated in FIG. 6, when the stapling process is executed a plurality of times at the position P2 and the position P3 different from the position P2 on a paper sheet P in the Y direction, the controller 22 (FIG. 3) executes the third control at the positions P2 and P3.

Figure 12:
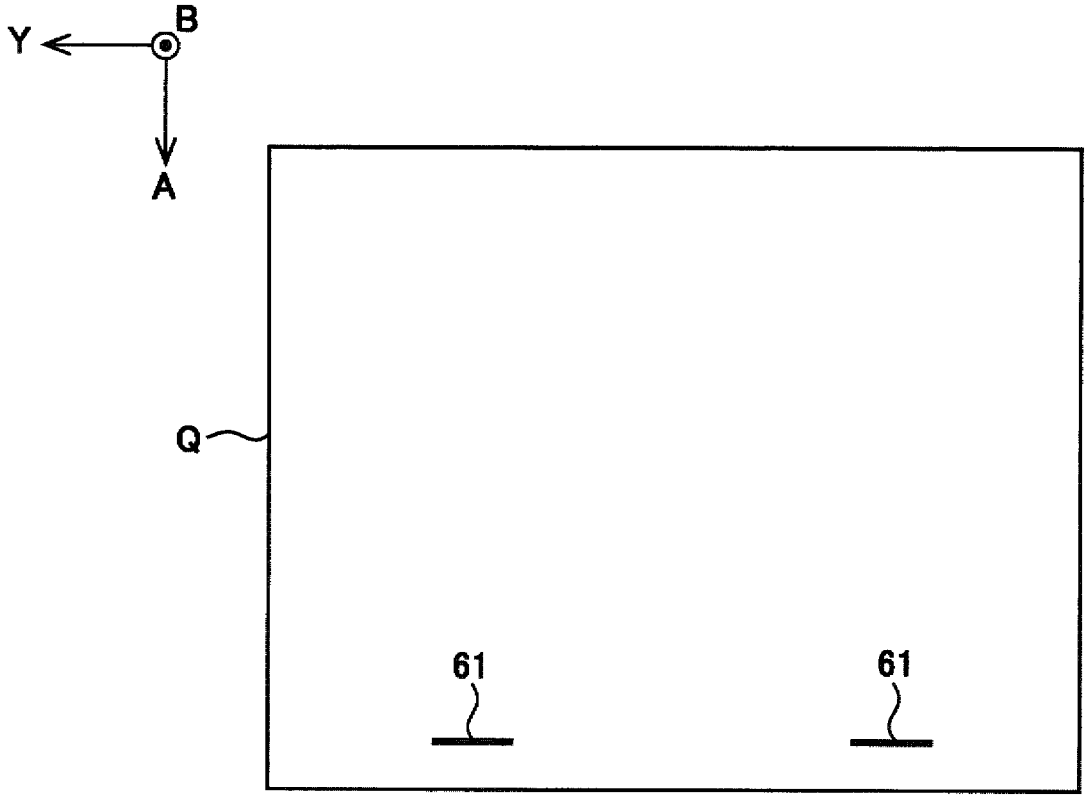
FIG. 12 is a schematic diagram illustrating a state in which the post-processing unit according to the second embodiment has executed a stapling process on two portions of each paper sheet.

Specifically, as illustrated in FIG. 12, a stack Q of paper sheets is stapled with two staples 61 at end portions of the stack Q of paper sheets in the positive A direction in such a manner that the two staples 61 are arranged at an interval in the Y direction.

Figure 13:
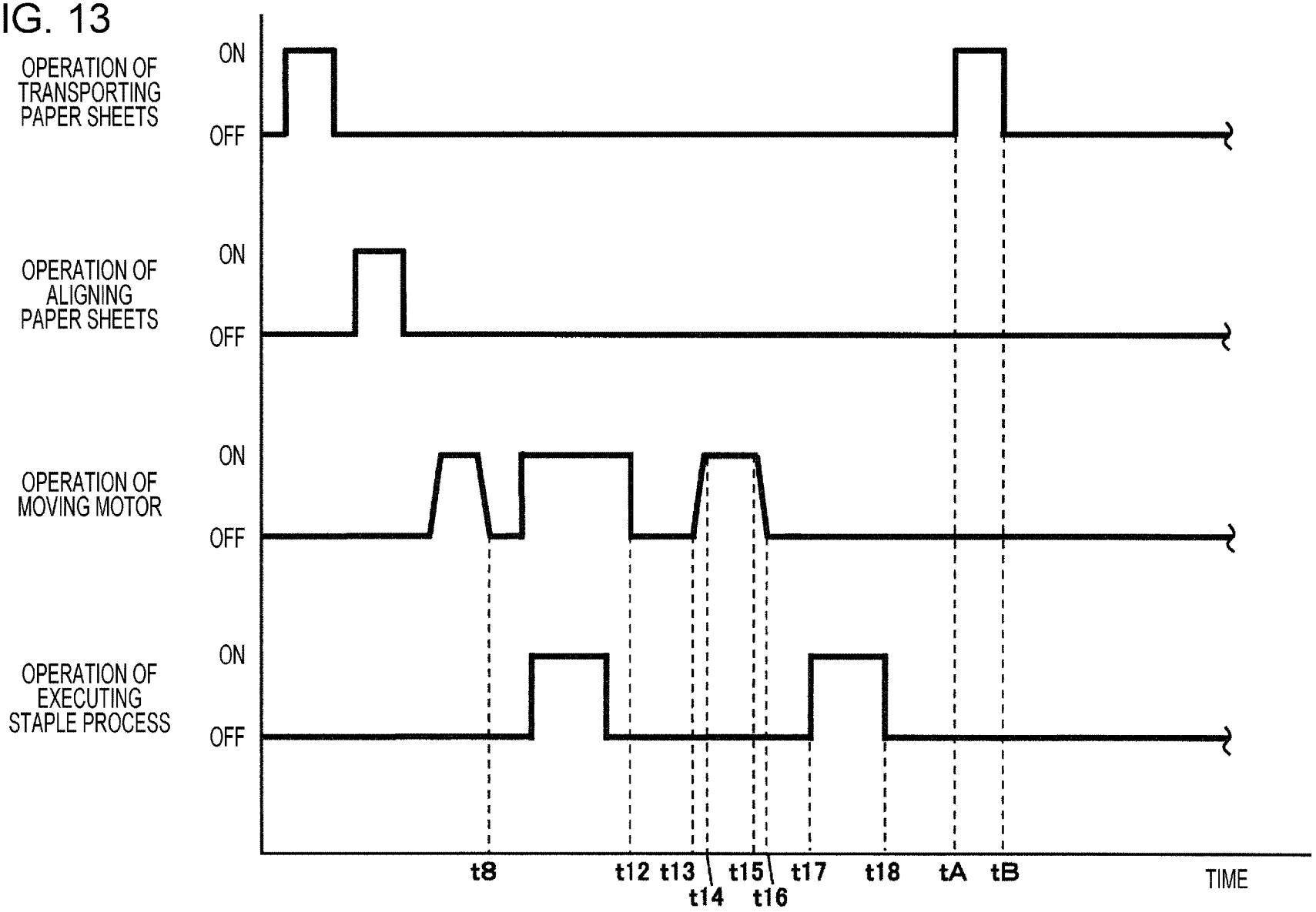
FIG. 13 is a timing chart illustrating an operation of transporting paper sheets, an operation of aligning the paper sheets, an operation of a moving motor, and an operation of a stapler to execute the stapling process in the post-processing unit according to the second embodiment at each time point.

FIG. 13 is a timing chart illustrating the case where an operation of transporting paper sheets P, an operation of aligning the paper sheets P, an operation of the moving motor 36, and an operation of the stapler 60 to execute the stapling process are executed on one stack Q of the paper sheets as an example of an operation of the post-processing unit 30 according to the second embodiment. In an actual operation, each of the operations illustrated in FIG. 13 is executed a plurality of times on a plurality of stacks Q of paper sheets. For the operations described above, an illustration and description of time points are omitted.

In the second embodiment, a time point t8 when the stapler 60 is stopped moving is set as an example of a reference time point.

After the first stapling process is executed at the position P2 (FIG. 6) before a time point t12, the set current Ia or the set voltage Va is supplied to the moving motor 36 at a time point t13 and the stapler 60 starts moving at a time point t14. The supply of the set current Ia or the set voltage Va to the moving motor 36 is stopped at a time point t15 and the stapler 60 is stopped moving at a time point t16. Therefore, the stapler 60 reaches the position P3 (FIG. 6).

The operation of the stapler 60 to execute the stapling process is started at a time point t17 and terminated at a time point t18.

Subsequently, the discharge of the stack Q of paper sheets is started by the discharge roller 48 (FIG. 1) at a time point tA and terminated at a time point tB. In this manner, the stapling process is executed twice on one stack Q of paper sheets. After that, the stapling process is executed on the second and subsequent stacks Q of paper sheets in the same manner as described above.

Next, actions of the post-processing unit 30 according to the second embodiment are described. Sections of the post-processing unit 30 are described with reference to FIGS. 1 to 6, and a description of the individual figure numbers is omitted.

Figure 14:
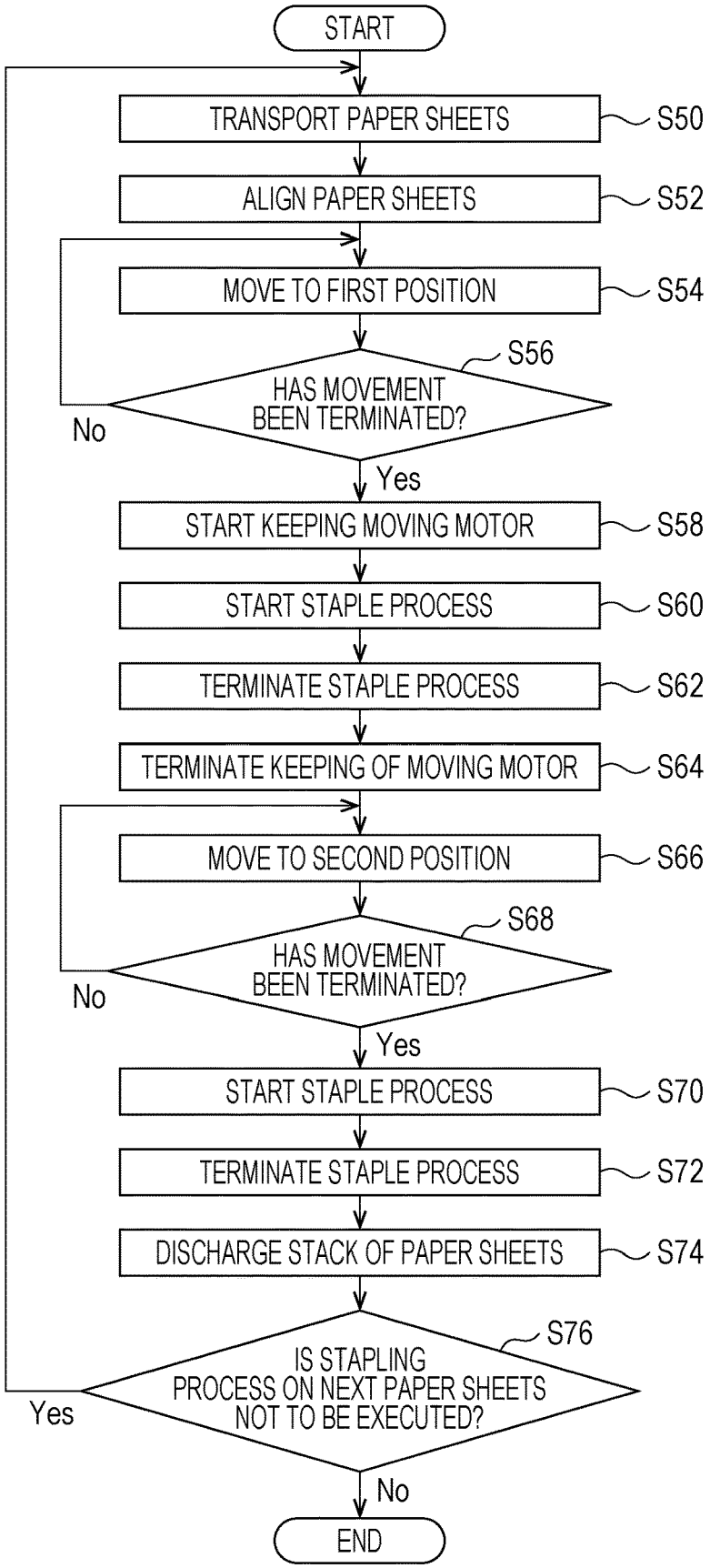
FIG. 14 is a flowchart illustrating a procedure for processes to be executed by the post-processing unit according to the second embodiment.

FIG. 14 is a flowchart illustrating a procedure for processes from a process of receiving paper sheets P by the controller 22 to a process of discharging a stack Q of the paper sheets after the stapling process. The CPU 24 reads the program PR from the memory 26 and loads and executes the program PR, thereby executing the processes illustrated in FIG. 14.

In step S50, the CPU 24 causes the paddle 46 to operate and transport a plurality of paper sheets P to the processing tray 32. Then, the process procedure proceeds to step S52.

In step S52, the CPU 24 causes the guide motor 38 to operate and move the side cursors 43 and 44, thereby causing the side cursors 43 and 44 to align the plurality of paper sheets P. Then, the process procedure proceeds to step S54.

In step S54, the CPU 24 causes the moving motor 36 to operate and move the stapler 60 from an initial position to the position P2. The stapler 60 may stand by at the position P2 from an initial state. Then, the process procedure proceeds to step S56.

In step S56, the CPU 24 determines whether the movement of the stapler 60 in the Y direction has been terminated. When the stapler 60 has reached the position P2 (Yes in S56), the process procedure proceeds to step S58. When the stapler 60 has not reached the position P2 (No in step S56), the process procedure proceeds to step S54.

In step S58, the CPU 24 supplies the supply current Ib or the supply voltage Vb to the moving motor 36 to keep the moving motor 36 in such a manner that the moving motor 36 does not rotate. Then, the process procedure proceeds to step S60.

In step S60, the CPU 24 causes the stapling motor 37 to operate to cause the stapler 60 to operate and start the stapling process. Then, the process procedure proceeds to step S62.

In step S62, the CPU 24 stops the operation of the stapling motor 37, thereby stopping the operation of the stapler 60. Then, the process procedure proceeds to step S64.

In step S64, the CPU 24 stops the supply of the supply current Ib or the supply voltage Vb to the moving motor 36. This terminates the keeping of the moving motor 36. Then, the process procedure proceeds to step S66.

In step S66, the CPU 24 causes the moving motor 36 to operate and move the stapler 60 from the position P2 to the position P3. Then, the process procedure proceeds to step S68.

In step S68, the CPU 24 determines whether the movement of the stapler 60 in the Y direction has been terminated. When the stapler 60 has reached the position P3 (Yes in step S68), the process procedure proceeds to step S70. When the stapler 60 has not reached the position P3 (No in step S68), the process procedure proceeds to step S66.

In step S70, the CPU 24 causes the stapling motor 37 to operate to cause the stapler 60 to operate and start the stapling process. Then, the process procedure proceeds to step S72.

In step S72, the CPU 24 stops the operation of the stapling motor 37, thereby stopping the operation of the stapler 60. Then, the process procedure proceeds to step S74.

In step S74, the CPU 24 causes the transport motor 23 to operate and rotate the discharge roller 48, thereby causing the discharge roller 48 to discharge the stack Q of paper sheets. Then, the process procedure proceeds to step S76.

In step S76, the CPU 24 determines whether the stapling process on the next paper sheets P is to be executed. As an example, the determination is made based on a difference between a set number of stacks Q of paper sheets and the number of stacks Q of paper sheets discharged. When the stapling process on the next paper sheets P is not to be executed (No in S76), the CPU 24 terminates the program PR. When the stapling process on the next paper sheets P is to be executed (Yes in step S76), the process procedure proceeds to step S50.

According to the post-processing unit 30 according to the second embodiment, the supply of the supply current Ib or the supply voltage Vb to the moving motor 36 of the driving section 34 is stopped when the stapler 60 is at the position P2 or P3. Therefore, it is possible to reduce power to be consumed by the post-processing unit 30, compared to a configuration in which the supply current Ib or the supply voltage Vb is continuously supplied to the driving section 34.

Although the recording systems 1 and the post-processing units 30 according to the first and second embodiments of the present disclosure basically have the foregoing configurations, a partial configuration may be modified, omitted, or the like without departing from the gist of the present disclosure. Modifications are described below.

In each of the post-processing units 30 according to the first and second embodiments, the controller 22 may not synchronize the operation of the stapler 60 to execute the stapling process with the operation of the driving section 34 using, as a reference time point, a time point when a signal is input before the start of the operation of the stapler 60 to execute the stapling process.

When the set time period elapses after the start time of the operation of the stapler 60 to execute the stapling process, the controller 22 may not stop the supply of the current or the voltage to the driving section 34. For example, when a predetermined time period elapses after the start time of a movement of the stapler 60, the controller 22 may stop the supply of the current or the voltage to the driving section 34.

When the set elapsed time period elapses after the end time of the operation of the stapler 60 to execute the stapling process, the controller 22 may not stop the supply of the current or the voltage to the driving section 34. For example, the end time of the operation of executing the stapling process may be the same as the time when the supply of the current or the voltage to the driving section 34 is stopped.

The first time period Δt1 may be the same as the second time period Δt2 or may be shorter than the second time period Δt2. The first time period Δt1 may be 0 and second time period Δt2 may be 0. The start time of the holding operation of the moving motor 36 may be after the start time of the operation of executing the stapling process as long as it is possible to reduce power to be consumed by the post-processing unit 30 and suppress a deviation of the position of the stapler 60 in the Y direction. Similarly, the end time of the holding operation of the moving motor 36 may be before the end time of the operation of executing the stapling process as long as it is possible to reduce power to be consumed by the post-processing unit 30 and suppress a deviation of the position of the stapler 60 in the Y direction.

The controller 22 may execute the second control in the last stapling process. Even when the number of times that the stapling process is executed on one portion of a paper sheet P is 1, the controller 22 may execute the second control.

Force that acts on the stapler 60 in the Y direction when the stapler 60 staples a paper sheet P may be equal to holding force caused by detent torque when the coil 36A is not excited.

A time point when the holding by the moving motor 36 is terminated may be the same as the end time of the stapling process by the stapler 60. A convergence time point when vibration of the stapler 60 converges after the stop of the stapling process may be checked in advance, and a time point when the holding by the moving motor 36 is terminated and the convergence time point may be set to the same time point.

As a reference time point when the holding by the moving motor 36 and the stapling process by the stapler 60 are synchronized, a time point when a paper sheet P is received may not be used. The start time or end time of a movement of the stapler 60 may be used as the reference time point.

In a time period for which the stapler 60 is not moved, the supply current Ib or the supply voltage Vb may be continuously supplied to the moving motor 36.

As an example of post-processing other than the stapling process, a process of pressing a plurality of paper sheets P to bond the paper sheets P together may be executed or a process of forming a through-hole extending through a plurality of paper sheets P in a thickness direction of the plurality of paper sheets P may be executed.

The supply of the supply current Ib or the supply of the supply voltage Vb may be selected. To control the moving motor 36, constant current control is preferably executed. However, to control the moving motor 36, constant voltage control may be executed.

The CPU 24 may not move the stapler 60 from the initial position after the alignment of a plurality of paper sheets P by the side cursors 43 and 44. For example, the CPU 24 may move the stapler 60 from the initial position at the same time as the alignment by the side cursors 43 and 44. Alternatively, the CPU 24 may move the stapler 60 from the initial position in the transport of a paper sheet P to the processing tray 32. Furthermore, the CPU 24 may move the stapler 60 from the initial position before the transport of a paper sheet P to the processing tray 32. Due to these operations, it is possible to shorten a time period required until the post-processing is terminated.

In the post-processing unit 30 according to the first embodiment, a position where the stapling process is executed on paper sheets P may not be limited to the position P4 where upper right portions of the paper sheets P. A position where the stapling process is executed on paper sheets P may be the position P1 where upper left portions of the paper sheets P.

In the post-processing unit 30 according to the second embodiment, the stapling process may be executed on other paper sheets P at the positions P2 and P3 and may be executed twice on a plurality of stacks Q of paper sheets. In addition, positions where the stapling process is executed on paper sheets P may not be limited to the two positions P2 and P3 and may be three or more positions. Furthermore, the end time of the stapling process and the end time of the holding by the moving motor 36 may be synchronized using the end time of the stapling process as a reference time point.

The medium may not be limited to a paper sheet P and may be a film, cloth, or the like.

The stapling process to be executed on paper sheets P is not limited to the process to be executed on a plurality of planar paper sheets P stacked in the B direction and may be a stapling process to be executed on a plurality of paper sheets P folded in advance and stacked in the B direction.

The stapling process may not be executed to staple paper sheets P with staples in such a manner that the staples are arranged along longer sides of the paper sheets P. The stapling process may be executed to staple paper sheets P with staples in such a manner that the staples are arranged along shorter sides of the paper sheets P.

What is claimed is:

1. A post-processing device comprising:

a post-processing section that is configured to move over a mounting section on which a medium is mounted in a width direction intersecting a transport direction of the medium and that executes post-processing on the medium mounted on the mounting section;

a driving section that moves the post-processing section in the width direction when supplied with a current or a voltage from a power supply; and a controller that controls an operation of the post-processing section and an operation of the driving section, wherein the controller is configured to execute a first control to move the post-processing section in the width direction by supplying a set current or a set voltage set from the power supply to the driving section, a second control to hold a position of the post-processing section in the width direction by supplying, to the driving section, a supply current with a same value as a value of the set current or a supply voltage with a same value as a value of the set voltage, and a third control to stop the supply of the supply current or the supply voltage to the driving section, and the controller causes the post-processing section to execute the post-processing during the execution of the second control.

2. The post-processing device according to claim 1, wherein the controller executes the first control to move the post-processing section, and the controller executes the second control and causes the post-processing section to execute the post-processing during the execution of the second control.

3. The post-processing device according to claim 1, wherein when the post-processing is executed at a first position and a second position different from the first position in the width direction on the medium, the controller executes the third control at the second position.

4. The post-processing device according to claim 1, wherein the controller synchronizes an operation of the post-processing section to execute the post-processing with an operation of the driving section using, as a reference time point, a time point when a signal is input before start of the operation of the post-processing section to execute the post-processing.

5. The post-processing device according to claim 1, wherein the controller starts the supply of the supply current or the supply voltage to the driving section before a start time of an operation of executing the post-processing.

6. The post-processing device according to claim 5, wherein when a set time period elapses after a start time of the supply of the supply current or the supply voltage to the driving section, the controller stops the supply of the current or the voltage to the driving section.

7. The post-processing device according to claim 5, wherein when a set elapsed time period elapses after an end time of the operation of the post-processing section to execute the post-processing, the controller stops the supply of the current or the voltage from the power supply to the driving section.

8. The post-processing device according to claim 1, wherein a first time period from an end time of the post-processing to an end time of the second control is longer than a second time period from a start time of the second control to a start time of the post-processing.

9. The post-processing device according to claim 1, wherein the controller causes the post-processing section to execute the post-processing without executing the second control in the last post-processing among a plurality of times of the post-processing.

10. The post-processing device according to claim 1, wherein when a number of times that the post-processing is executed on a single portion of the medium is 1, the controller causes the post-processing section to execute the post-processing without executing the second control.

11. The post-processing device according to claim 1, wherein the post-processing section is a stapling section that staples the medium, the driving section includes a stepping motor having a coil that is excited by supplying a current to the coil.

12. The post-processing device according to claim 11, wherein force that acts on the stapling section in the width direction when the stapling section staples the medium is larger than holding force caused by detent torque when the coil is not excited.

* * * * *